US008567512B2

(12) United States Patent
Odell, II et al.

(10) Patent No.: US 8,567,512 B2
(45) Date of Patent: Oct. 29, 2013

(54) APPARATUS FOR GRIPPING A TUBULAR ON A DRILLING RIG

(75) Inventors: Albert C. Odell, II, Kingwood, TX (US); Richard Lee Giroux, Cypress, TX (US); Tuong Thanh Le, Katy, TX (US); Gary Thompson, Katy, TX (US); Karsten Heidecke, Houston, TX (US); Joerg Lorenz, Burgwedel (DE); Doyle Frederic Boutwell, Jr., Houston, TX (US); Michael Hayes, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 37 days.

(21) Appl. No.: 13/009,475

(22) Filed: Jan. 19, 2011

(65) Prior Publication Data

US 2011/0174483 A1 Jul. 21, 2011

Related U.S. Application Data

(62) Division of application No. 11/609,709, filed on Dec. 12, 2006, now Pat. No. 7,874,352.

(60) Provisional application No. 60/749,451, filed on Dec. 12, 2005.

(51) Int. Cl.
*E21B 19/16* (2006.01)
*E21B 19/02* (2006.01)

(52) U.S. Cl.
USPC ..... 166/379; 166/75.14; 166/77.51; 166/85.1

(58) Field of Classification Search
USPC ..... 166/77.51, 75.14, 77.52, 77.53, 379, 166/85.1; 414/22.51, 800, 729, 730, 630, 414/625, 650
See application file for complete search history.

(56) References Cited

U.S. PATENT DOCUMENTS

| | | | |
|---|---|---|---|
| 179,973 | A | 7/1876 | Thornton |
| 1,414,207 | A | 4/1922 | Reed |
| 1,418,766 | A | 6/1922 | Wilson |
| 1,585,069 | A | 5/1926 | Youle |
| 1,728,136 | A | 9/1929 | Power |
| 1,777,592 | A | 10/1930 | Thomas |

(Continued)

FOREIGN PATENT DOCUMENTS

| | | | |
|---|---|---|---|
| CA | 2 307 386 | A1 | 11/2000 |
| DE | 3523221 | A1 | 1/1987 |

(Continued)

OTHER PUBLICATIONS

Chinese Office Action for Application No. 200680052591.0 dated Jun. 2, 2011.

(Continued)

*Primary Examiner* — Jennifer H Gay
(74) *Attorney, Agent, or Firm* — Patterson & Sheridan, LLP

(57) ABSTRACT

Methods and apparatus are provided for running tubulars into and out of a wellbore. A tubular handling system having a tubular gripping apparatus having a gripping mechanism and a sensor adapted to track movement of the gripping mechanism, wherein the sensor sends a signal to a controller when the gripping apparatus is in a position that corresponds to the gripping apparatus being engaged with the tubular.

19 Claims, 19 Drawing Sheets

(56) References Cited

U.S. PATENT DOCUMENTS 1,805,007 A 5/1931 Pedley
1,825,026 A 9/1931 Thomas
1,842,638 A 1/1932 Wigle
1,917,135 A 7/1933 Littell
2,105,885 A 1/1938 Hinderliter
2,128,430 A 8/1938 Pryor
2,167,338 A 7/1939 Murcell
2,184,681 A 12/1939 Osmun et al.
2,214,429 A 9/1940 Miller
2,414,719 A 1/1947 Cloud
2,522,444 A 9/1950 Grable
2,536,458 A 1/1951 Munsinger
2,570,080 A 10/1951 Stone
2,582,987 A 1/1952 Hagenbook
2,595,902 A 5/1952 Stone
2,610,690 A 9/1952 Beatty
2,641,444 A 6/1953 Moon
2,668,689 A 2/1954 Cormany
2,692,059 A 10/1954 Bolling, Jr.
2,953,406 A 9/1960 Young
2,965,177 A 12/1960 Bus et al.
3,041,901 A 7/1962 Knights
3,087,546 A 4/1963 Wooley
3,122,811 A 3/1964 Gilreath
3,191,683 A 6/1965 Alexander
3,193,116 A 7/1965 Kenneday et al.
3,266,582 A 8/1966 Homanick
3,305,021 A 2/1967 Lebourg
3,321,018 A 5/1967 McGill
3,380,528 A 4/1968 Timmons
3,392,609 A 7/1968 Bartos
3,477,527 A 11/1969 Koot
3,489,220 A 1/1970 Kinley
3,518,903 A 7/1970 Ham et al.
3,540,266 A * 11/1970 Lofgren ..... 73/637
3,548,936 A 12/1970 Kilgore et al.
3,552,507 A 1/1971 Brown
3,552,508 A 1/1971 Brown
3,552,509 A 1/1971 Brown
3,552,510 A 1/1971 Brown
3,566,505 A 3/1971 Martin
3,570,598 A 3/1971 Johnson
3,602,302 A 8/1971 Kluth
3,606,664 A 9/1971 Weiner
3,635,105 A 1/1972 Dickmann et al.
3,638,989 A 2/1972 Sandquist
3,662,842 A 5/1972 Bromell
3,680,412 A 8/1972 Mayer et al.
3,691,825 A 9/1972 Dyer
3,697,113 A 10/1972 Palauro et al.
3,700,048 A 10/1972 Desmoulins
3,706,347 A 12/1972 Brown
3,746,330 A 7/1973 Taciuk
3,747,675 A 7/1973 Brown
3,766,991 A 10/1973 Brown
3,776,320 A 12/1973 Brown
3,780,883 A 12/1973 Brown
3,808,916 A 5/1974 Porter et al.
3,838,613 A 10/1974 Wilms
3,840,128 A 10/1974 Swoboda, Jr. et al.
3,848,684 A 11/1974 West
3,857,450 A 12/1974 Guier
3,881,375 A 5/1975 Kelly
3,885,679 A 5/1975 Swoboda, Jr. et al.
3,901,331 A 8/1975 Djurovic
3,913,687 A 10/1975 Gyongyosi et al.
3,915,244 A 10/1975 Brown
3,961,399 A 6/1976 Boyadjieff
3,964,552 A 6/1976 Slator
3,980,143 A 9/1976 Swartz et al.
4,054,332 A 10/1977 Bryan, Jr.
4,077,525 A 3/1978 Callegari et al.
4,100,968 A 7/1978 Delano
4,127,927 A 12/1978 Hauk et al.
4,142,739 A 3/1979 Billingsley
4,202,225 A 5/1980 Sheldon et al.
4,221,269 A 9/1980 Hudson
4,257,442 A 3/1981 Claycomb
4,262,693 A 4/1981 Giebeler
4,274,777 A 6/1981 Scaggs
4,274,778 A 6/1981 Putnam et al.
4,280,380 A 7/1981 Eshghy
4,315,553 A 2/1982 Stallings
4,320,915 A 3/1982 Abbott et al.
4,401,000 A 8/1983 Kinzbach
4,402,239 A 9/1983 Mooney
4,437,363 A 3/1984 Haynes
4,440,220 A 4/1984 McArthur
4,446,745 A 5/1984 Stone et al.
4,449,596 A 5/1984 Boyadjieff
4,472,002 A 9/1984 Beney et al.
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,545,017 A 10/1985 Richardson
4,570,706 A 2/1986 Pugnet
4,592,125 A 6/1986 Skene
4,593,584 A 6/1986 Neves
4,593,773 A 6/1986 Skeie
4,604,724 A 8/1986 Shaginian et al.
4,604,818 A 8/1986 Inoue
4,605,077 A 8/1986 Boyadjieff
4,613,161 A 9/1986 Brisco
4,625,796 A 12/1986 Boyadjieff
4,646,827 A 3/1987 Cobb
4,649,777 A 3/1987 Buck
4,652,195 A 3/1987 McArthur
4,667,752 A 5/1987 Berry et al.
4,676,312 A 6/1987 Mosing et al.
4,681,158 A 7/1987 Pennison
4,681,162 A 7/1987 Boyd
4,683,962 A 8/1987 True
4,686,873 A 8/1987 Lang et al.
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,759,239 A 7/1988 Hamilton et al.
4,762,187 A 8/1988 Haney
4,765,401 A 8/1988 Boyadjieff
4,765,416 A 8/1988 Bjerking et al.
4,773,689 A 9/1988 Wolters
4,781,359 A 11/1988 Matus
4,791,997 A 12/1988 Krasnov
4,793,422 A 12/1988 Krasnov
4,800,968 A 1/1989 Shaw et al.
4,813,493 A 3/1989 Shaw et al.
4,813,495 A 3/1989 Leach
4,821,814 A 4/1989 Willis et al.
4,832,552 A 5/1989 Skelly
4,836,064 A 6/1989 Slator
4,843,945 A 7/1989 Dinsdale
4,854,383 A 8/1989 Arnold et al.
4,867,236 A 9/1989 Haney et al.
4,875,530 A 10/1989 Frink et al.
4,878,546 A 11/1989 Shaw et al.
4,899,816 A 2/1990 Mine
4,909,741 A 3/1990 Schasteen et al.
4,921,386 A 5/1990 McArthur
4,936,382 A 6/1990 Thomas
4,962,579 A 10/1990 Moyer et al.
4,962,819 A 10/1990 Bailey et al.
4,971,146 A 11/1990 Terrell
4,997,042 A 3/1991 Jordan et al.
5,022,472 A 6/1991 Bailey et al.
5,036,927 A 8/1991 Willis
5,049,020 A 9/1991 McArthur
5,060,542 A 10/1991 Hauk
5,062,756 A 11/1991 McArthur et al.
5,081,888 A 1/1992 Schulze-Beckinghausen

(56) References Cited

U.S. PATENT DOCUMENTS 5,083,356 A 1/1992 Gonzalez et al.
5,107,940 A 4/1992 Berry
5,111,893 A 5/1992 Kvello-Aune
RE34,063 E 9/1992 Vincent et al.
5,161,438 A 11/1992 Pietras
5,191,939 A 3/1993 Stokley
5,207,128 A 5/1993 Albright
5,233,742 A 8/1993 Gray et al.
5,245,265 A 9/1993 Clay
5,251,709 A 10/1993 Richardson
5,255,751 A 10/1993 Stogner
5,272,925 A 12/1993 Henneuse et al.
5,282,653 A 2/1994 LaFleur et al.
5,284,210 A 2/1994 Helms et al.
5,294,228 A 3/1994 Willis et al.
5,297,833 A 3/1994 Willis et al.
5,305,839 A 4/1994 Kalsi et al.
5,332,043 A 7/1994 Ferguson
5,340,182 A 8/1994 Busink et al.
5,351,767 A 10/1994 Stogner et al.
5,354,150 A 10/1994 Canales
5,368,113 A 11/1994 Schulze-Beckinghausen
5,386,746 A 2/1995 Hauk
5,388,651 A 2/1995 Berry
5,433,279 A 7/1995 Tessari et al.
5,458,454 A * 10/1995 Sorokan ..... 414/800
5,461,905 A 10/1995 Penisson
5,497,840 A 3/1996 Hudson
5,501,280 A 3/1996 Brisco
5,501,286 A 3/1996 Berry
5,503,234 A 4/1996 Clanton
5,535,824 A 7/1996 Hudson
5,575,344 A 11/1996 Wireman
5,577,566 A 11/1996 Albright et al.
5,584,343 A 12/1996 Coone
5,588,916 A 12/1996 Moore
5,645,131 A 7/1997 Trevisani
5,661,888 A 9/1997 Hanslik
5,667,026 A 9/1997 Lorenz et al.
5,706,894 A 1/1998 Hawkins, III
5,711,382 A 1/1998 Hansen et al.
5,735,348 A 4/1998 Hawkins, III
5,735,351 A 4/1998 Helms
5,736,938 A 4/1998 Ruthroff
5,746,276 A 5/1998 Stuart
5,765,638 A 6/1998 Taylor
5,772,514 A 6/1998 Moore
5,785,132 A 7/1998 Richardson et al.
5,791,410 A 8/1998 Castille et al.
5,803,191 A 9/1998 Mackintosh
5,806,589 A 9/1998 Lang
5,833,002 A 11/1998 Holcombe
5,836,395 A 11/1998 Budde
5,839,330 A 11/1998 Stokka
5,842,530 A 12/1998 Smith et al.
5,850,877 A 12/1998 Albright et al.
5,890,549 A 4/1999 Sprehe
5,909,768 A 6/1999 Castille et al.
5,931,231 A 8/1999 Mock
5,960,881 A 10/1999 Allamon et al.
5,971,079 A 10/1999 Mullins
5,971,086 A 10/1999 Bee et al.
6,000,472 A 12/1999 Albright et al.
6,012,529 A 1/2000 Mikolajczyk et al.
6,056,060 A 5/2000 Abrahamsen et al.
6,065,550 A 5/2000 Gardes
6,070,500 A 6/2000 Dlask et al.
6,079,509 A 6/2000 Bee et al.
6,119,772 A 9/2000 Pruet
6,142,545 A 11/2000 Penman et al.
6,161,617 A 12/2000 Gjedebo
6,170,573 B1 1/2001 Brunet et al.
6,173,777 B1 1/2001 Mullins
6,189,621 B1 2/2001 Vail, III
6,199,641 B1 3/2001 Downie et al.
6,202,764 B1 3/2001 Ables et al.
6,217,258 B1 4/2001 Yamamoto et al.
6,220,807 B1 * 4/2001 Sorokan ..... 414/22.62
6,227,587 B1 5/2001 Terral
6,237,684 B1 5/2001 Bouligny, Jr. et al.
6,276,450 B1 8/2001 Seneviratne
6,279,654 B1 8/2001 Mosing et al.
6,309,002 B1 10/2001 Bouligny
6,311,792 B1 11/2001 Scott et al.
6,315,051 B1 11/2001 Ayling
6,334,376 B1 1/2002 Torres
6,349,764 B1 2/2002 Adams et al.
6,360,633 B2 3/2002 Pietras
6,378,630 B1 4/2002 Ritorto et al.
6,390,190 B2 5/2002 Mullins
6,412,554 B1 7/2002 Allen et al.
6,415,862 B1 7/2002 Mullins
6,431,626 B1 8/2002 Bouligny
6,443,241 B1 9/2002 Juhasz et al.
6,527,047 B1 3/2003 Pietras
6,527,493 B1 3/2003 Kamphorst et al.
6,536,520 B1 3/2003 Snider et al.
6,553,825 B1 4/2003 Boyd
6,571,868 B2 6/2003 Victor
6,591,471 B1 7/2003 Hollingsworth et al.
6,595,288 B2 7/2003 Mosing et al.
6,622,796 B1 9/2003 Pietras
6,626,238 B2 9/2003 Hooper
6,637,526 B2 10/2003 Juhasz et al.
6,651,737 B2 11/2003 Bouligny et al.
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,695,559 B1 2/2004 Pietras
6,705,405 B1 3/2004 Pietras
6,725,938 B1 4/2004 Pietras
6,725,949 B2 4/2004 Seneviratne
6,732,822 B2 5/2004 Slack et al.
6,742,584 B1 6/2004 Appleton
6,742,596 B2 * 6/2004 Haugen ..... 166/380
6,832,656 B2 12/2004 Fournier, Jr. et al.
6,832,658 B2 12/2004 Keast
6,840,322 B2 1/2005 Haynes et al.
6,845,825 B2 1/2005 Bischel et al.
6,892,835 B2 5/2005 Shahin et al.
6,907,934 B2 6/2005 Kauffman et al.
6,938,697 B2 9/2005 Haugen
6,968,895 B2 11/2005 Mosing et al.
6,976,298 B1 12/2005 Pietras
6,994,176 B2 2/2006 Shahin et al.
7,004,259 B2 2/2006 Pietras
7,028,586 B2 4/2006 Robichaux et al.
7,044,241 B2 5/2006 Angman
7,073,598 B2 * 7/2006 Haugen ..... 166/380
7,090,021 B2 8/2006 Pietras
7,096,977 B2 8/2006 Juhasz et al.
7,100,698 B2 9/2006 Kracik et al.
7,107,875 B2 9/2006 Haugen et al.
7,117,938 B2 10/2006 Hamilton et al.
7,128,161 B2 10/2006 Pietras
7,140,443 B2 11/2006 Beierbach et al.
7,140,445 B2 11/2006 Shahin et al.
7,182,133 B2 * 2/2007 Webre et al. ..... 166/250.01
7,188,686 B2 3/2007 Folk et al.
7,191,840 B2 3/2007 Pietras et al.
7,213,656 B2 5/2007 Pietras
7,264,050 B2 9/2007 Koithan et al.
7,296,623 B2 11/2007 Koithan et al.
7,325,610 B2 2/2008 Giroux et al.
7,779,922 B1 8/2010 Harris et al.
7,874,352 B2 * 1/2011 Odell et al. ..... 166/77.51
7,882,902 B2 * 2/2011 Boutwell, Jr. ..... 175/40
7,896,084 B2 * 3/2011 Haugen ..... 166/380
8,051,909 B2 * 11/2011 Angelle et al. ..... 166/250.01
8,136,603 B2 * 3/2012 Schneider ..... 166/380
2001/0042625 A1 11/2001 Appleton

(56) References Cited

U.S. PATENT DOCUMENTS

| | | | | |
|---|---|---|---|---|
| 2002/0108748 | A1 | 8/2002 | Keyes | |
| 2002/0170720 | A1 | 11/2002 | Haugen | |
| 2003/0164276 | A1 | 9/2003 | Snider et al. | |
| 2003/0173073 | A1 | 9/2003 | Snider et al. | |
| 2003/0221871 | A1 | 12/2003 | Hamilton et al. | |
| 2004/0003490 | A1 | 1/2004 | Shahin et al. | |
| 2004/0026088 | A1* | 2/2004 | Pietras et al. | 166/379 |
| 2004/0069500 | A1* | 4/2004 | Haugen | 166/380 |
| 2004/0144547 | A1 | 7/2004 | Koithan et al. | |
| 2004/0159425 | A1* | 8/2004 | Webre et al. | 166/66 |
| 2004/0188098 | A1* | 9/2004 | Schulze-Beckinghausen et al. | 166/380 |
| 2005/0000691 | A1 | 1/2005 | Giroux et al. | |
| 2005/0000696 | A1* | 1/2005 | McDaniel et al. | 166/379 |
| 2005/0051343 | A1 | 3/2005 | Pietras et al. | |
| 2005/0247483 | A1 | 11/2005 | Koch et al. | |
| 2005/0257933 | A1 | 11/2005 | Pietras | |
| 2006/0000600 | A1 | 1/2006 | Pietras | |
| 2006/0124353 | A1 | 6/2006 | Juhasz et al. | |
| 2006/0180315 | A1 | 8/2006 | Shahin et al. | |
| 2007/0000668 | A1 | 1/2007 | Christensen | |
| 2007/0017682 | A1 | 1/2007 | Abrahamsen et al. | |
| 2007/0131416 | A1* | 6/2007 | Odell et al. | 166/250.1 |
| 2007/0169930 | A1* | 7/2007 | Shahin et al. | 166/77.52 |
| 2008/0149326 | A1* | 6/2008 | Angelle et al. | 166/77.52 |
| 2008/0173380 | A1 | 7/2008 | Ohara | |
| 2008/0264648 | A1 | 10/2008 | Pietras et al. | |
| 2009/0151934 | A1 | 6/2009 | Heidecke et al. | |
| 2009/0272542 | A1 | 11/2009 | Begnaud et al. | |
| 2009/0274545 | A1 | 11/2009 | Liess et al. | |
| 2010/0193198 | A1 | 8/2010 | Murray et al. | |
| 2011/0017474 | A1 | 1/2011 | Pietras et al. | |
| 2011/0174483 | A1* | 7/2011 | Odell et al. | 166/250.01 |
| 2011/0226486 | A1 | 9/2011 | Haugen | |
| 2012/0152530 | A1 | 6/2012 | Wiedecke et al. | |

FOREIGN PATENT DOCUMENTS

| | | | |
|---|---|---|---|
| EP | 0087373 | A1 | 8/1983 |
| EP | 0 162 000 | A1 | 11/1985 |
| EP | 0 171 144 | A1 | 2/1986 |
| EP | 0 285 386 | A2 | 10/1988 |
| EP | 0 474 481 | A2 | 3/1992 |
| EP | 1148206 | A2 | 10/2001 |
| EP | 1 256 691 | A2 | 11/2002 |
| GB | 2 053 088 | A | 2/1981 |
| GB | 2 224 481 | A | 5/1990 |
| GB | 2 275 486 | A | 8/1994 |
| GB | 2 357 530 | A | 6/2001 |
| JP | 2001/173349 | A | 6/2001 |
| RU | 2004769 | C1 | 12/1993 |
| SU | 236377 | | 6/1969 |
| WO | 9307358 | A1 | 4/1993 |
| WO | 96-18799 | A1 | 6/1996 |
| WO | 97-08418 | A1 | 3/1997 |
| WO | 98-05844 | A1 | 2/1998 |
| WO | 98/32948 | A1 | 7/1998 |
| WO | 99-11902 | A1 | 3/1999 |
| WO | 99-58810 | A2 | 11/1999 |
| WO | 00-08293 | A1 | 2/2000 |
| WO | 00-09853 | A1 | 2/2000 |
| WO | 00-50730 | A1 | 8/2000 |
| WO | 01-33033 | A1 | 5/2001 |
| WO | 0169034 | A2 | 9/2001 |
| WO | 01/79652 | A1 | 10/2001 |
| WO | WO 01/79652 | | 10/2001 |
| WO | 03/054338 | A2 | 7/2003 |
| WO | 2004-022903 | A2 | 3/2004 |
| WO | 2004/101417 | A2 | 11/2004 |
| WO | 2005/090740 | A1 | 9/2005 |

OTHER PUBLICATIONS

Norwegian Office Action and Search Report dated May 6, 2012, Norwegian Patent Application No. 20082811.

EA Search Report from Application No. 200870051 dated Nov. 11, 2008.

"First Success with Casing-Drilling" World Oil, Feb. 1999, pp. 25.

Laurent, et al., "A New Generation Drilling Rig: Hydraulically Powered and Computer Controlled," CADE/CAODC Paper 99-120, CADE/CAODC Spring Drilling Conference, Apr. 7 & 8, 1999, 14 pages.

Laurent, et al., "Hydraulic Rig Supports Casing Drilling," World Oil, Sep. 1999, pp. 61-68.

Shepard, et al., "Casing Drilling: An Emerging Technology," IADC/SPE Paper 67731, SPE/IADC Drilling Conference, Feb. 27-Mar. 1, 2001, pp. 1-13.

Warren, et al., "Casing Drilling Technology Moves to More Challenging Application," AADE Paper 01-NC-HO-32, AADE National Drilling Conference, Mar. 27-29, 2001, pp. 1-10.

Fontenot, et al., "New Rig Design Enhances Casing Drilling Operations in Lobo Trend," paper WOCD-0306-04, World Oil Casing Drilling Technical Conference, Mar. 6-7, 2003, pp. 1-13.

Vincent, et al., "Liner and Casing Drilling—Case Histories and Technology," Paper WOCD-0307-02, World Oil Casing Drilling Technical Conference, Mar. 6-7, 2003, pp. 1-20.

Tessari, et al., "Retrievable Tools Provide Flexibility for Casing Drilling," Paper No. WOCD-0306-01, World Oil Casing Drilling Technical Conference, 2003, pp. 1-11.

Tommy Warren, SPE, Bruce Houtchens, SPE, Garret Madell, Spe, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving the Market?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANRIG Drilling Technology, Ltd., Sep. 18, 1996.

Coiled Tubing Handbook, World Oil, Gulf Publishing Company, 1993.

Bickford L Dennis and Mark J. Mabile, Casing Drilling Rig Selection for Stratton Field, Texas, World Oil, vol. 226, No. 3, Mar. 2005.

G H. Kamphorst, G. L. Van Wechem, W. Boom, D. Bottger, and K. Koch, Casing Running Tool, SPE/IADC 52770.

PCT Search, Application No. PCT/US2006/061945, dated Jul. 5, 2007.

Canadian Office Action for Application No. 2,633,182 dated May 18, 2010.

Eurasian Patent Office Search Report for 201100260 dated Aug. 10, 2011.

* cited by examiner

APPARATUS FOR GRIPPING A TUBULAR ON A DRILLING RIG

CROSS-REFERENCE TO RELATED APPLICATIONS

This application is a divisional of U.S. patent application Ser. No. 11/609,709, filed on Dec. 12, 2006, now U.S. Pat. No. 7,874,352, which application claims benefit of U.S. Provisional Patent Application Ser. No. 60/749,451, filed Dec. 12, 2005, each application is incorporated herein by reference in its entirety.

BACKGROUND OF THE INVENTION

1. Field of the Invention

Embodiments of the present invention generally relate to a gripping assembly for gripping tubulars. More particularly, the invention relates to a gripping apparatus for connecting wellbore tubulars on a drilling rig. More particularly still, the invention relates to a method of operating a tubular handling system.

2. Description of the Related Art

In the construction and completion of oil and gas wells, a drilling rig is located on the earth's surface to facilitate the insertion and removal of tubular strings to and from a wellbore. The tubular strings are constructed and run into the hole by lowering a string into a wellbore until only the upper end of the top tubular extends from the wellbore (or above the rig floor). A gripping device, such as a set of slips or a spider at the surface of the wellbore, or on the rig floor, holds the tubular in place with bowl-shaped slips while the next tubular to be connected is lifted over the wellbore center. Typically, the next tubular has a lower end with a pin end, male threaded connection, for threadedly connecting to a box end, female threaded connection, of the tubular string extending from the wellbore. The tubular to be added is then rotated, using a top drive, relative to the string until a joint of a certain torque is made between the tubulars.

A tubular connection may be made near the floor of the drilling rig using a power tong. Alternatively, a top drive facilitates connection of tubulars by rotating the tubular from its upper end. The top drive is typically connected to the tubular by using a tubular gripping tool that grips the tubular. With the tubular coupled to a top drive, the top drive may be used to make up or break out tubular connections, lower a string into the wellbore, or even drill with the string when the string includes an earth removal member at its lower end.

An internal gripping device or spear may grip the inside diameter of a tubular to temporarily hold the tubular while building a string or rotating the string to drill. An internal gripping device is typically connected at an upper end to a top drive and at a lower end the internal gripping device includes outwardly extending gripping members configured to contact and hold the interior of the tubular in order to transmit axial and torsional loads. To engage the tubular, it may be useful to monitor the position of the tubular gripping apparatus and the gripping mechanism in the tubular gripping apparatus.

There is a need for an improved tubular handling assembly capable of tracking a position of the tubular gripping apparatus and the gripping mechanism. There is also a need for an integrated safety system between the gripping apparatus and a gripper on the rig floor.

SUMMARY OF THE INVENTION

Embodiments described herein relate to a method and apparatus for handling tubular on a drilling rig. The apparatus is adapted for gripping a tubular and may be used with a top drive. The apparatus includes a connection at one end for rotationally fixing the apparatus to the top drive and gripping members at a second end for gripping the tubular. The apparatus has a primary actuator configured to move and hold the gripping members in contact with the tubular and a backup assembly to maintain the gripping member in contact with the tubular.

In another embodiment described herein, a safety system for use with a tubular handling system is described. The safety system includes a sensor adapted to track movement of a slip ring for actuating a gripping apparatus, wherein the sensor sends a signal to a controller when the gripping apparatus is in a position that corresponds to the gripping apparatus being engaged with the tubular.

In yet another embodiment, the sensor comprises a trigger which is actuated by a wheel coupled to an arm, wherein the wheel moves along a track coupled to an actuator as the actuator moves the slip ring. Additionally, the track may have one or more upsets configured to move the wheel radially and actuate the trigger as the wheel travels.

In yet another embodiment described herein, a method for monitoring a tubular handling system is described. The method includes moving a gripping apparatus toward a tubular and engaging a sensor located on a stop collar of the gripping apparatus to an upper end of the tubular. The method further includes sending a signal from the sensor to a controller indicating that the tubular is in an engaged position and stopping movement of the gripping apparatus relative to the tubular in response to the signal. Additionally, the method may include gripping the tubular with the gripping apparatus.

In yet another embodiment, the method further includes monitoring a position of one or more engagement members of the gripping apparatus relative to the tubular using a second sensor, and sending a second signal to the controller indicating that the gripping apparatus is engaged with the tubular.

In yet another embodiment, the method further includes coupling the tubular to a tubular string held by a spider on the rig floor and verifying that the tubular connection is secure.

In yet another embodiment, the method further includes having verified the tubular connection is secure and the gripping apparatus is secure the controller permits release of the spider.

BRIEF DESCRIPTION OF THE DRAWINGS

So that the manner in which the above recited features of the present invention may be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
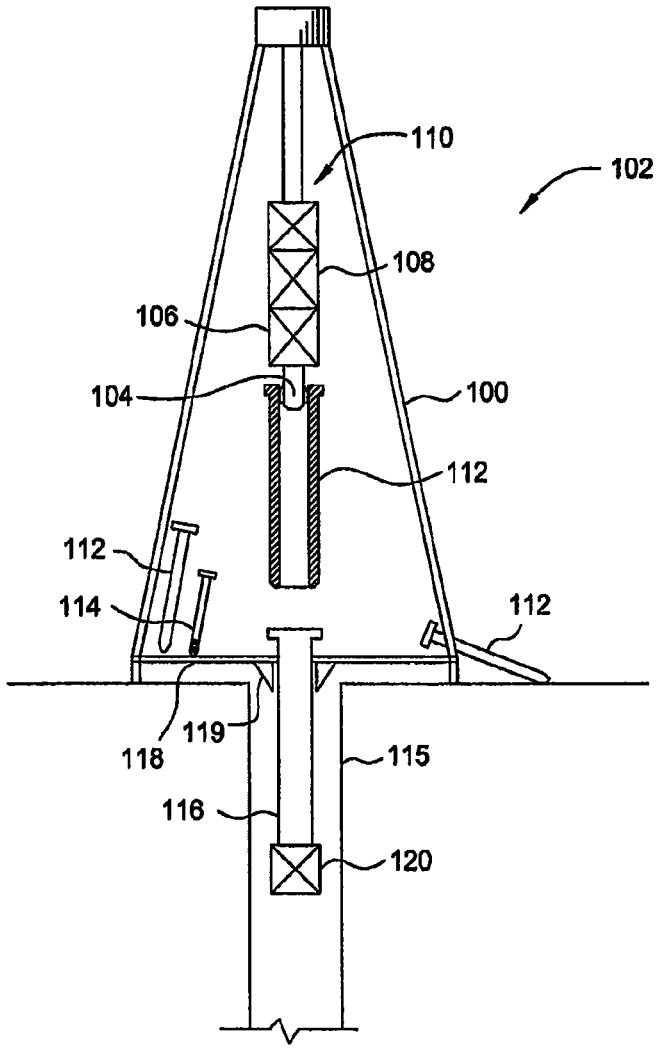
FIG. 1 is a schematic of a drilling rig and a wellbore according to one embodiment described herein.

FIG. 1 is a schematic view of a drilling rig 100 having a tubular handling system 102. As shown, the tubular handling system 102 includes a gripping apparatus 104, an actuator 106, a drive mechanism 108, and a hoisting system 110. The tubular handling system 102 is adapted to grip a tubular 112 or a piece of equipment 114 and lift it over the wellbore 115 and then complete a tubular running operation. The actuator 106 for the gripping apparatus 104 may be equipped with a backup safety assembly, a locking system and a safety system, described in more detail below, for ensuring the tubular 112 is not released prematurely. The hoisting system 110 and/or the drive mechanism 108 may lower the tubular 112 until the tubular 112 contacts a tubular string 116. The drive mechanism 108 may then be used to rotate the tubular 112 or the piece of equipment 114 depending on the application in order to couple the tubular 112 to the tubular string 116, thereby extending the length of the tubular string 116. After the coupling, a gripper 119 on the rig floor 118, which initially retains the tubular string 116, may then release the tubular string 116. The gripper 119 as shown is a set of slips; however, it should be appreciated that the gripper 119 may be any gripper on the rig floor 118 including, but not limited to, a spider. With the gripping apparatus 104 gripping the tubular 112 and thereby the tubular string 116, the hoisting system 110, and/or drive mechanism 108 may lower the tubular 112 and the tubular string 116 until the top of the tubular 112 is near the rig floor 118. The gripper 119 is then re-activated to grip the extended tubular string 116 near the rig floor 118, thereby retaining the extended tubular string 116 in the well. The actuator 106 releases the gripping apparatus 104 from the tubular 112. The tubular handling system 102 may then be used to grip the next tubular 112 to be added to the tubular string 116. This process is repeated until the operation is complete. While lowering the tubular string 116, the drive mechanism 108 may rotate the tubular string 116. If the tubular string 116 is equipped with a drilling tool 120, shown schematically, rotation of the tubular string 116 may drill out the wellbore as the tubular string 116 is lowered. The tubular 112 may be any jointed tubular or segment including but not limited to casing, liner, production tubing, drill pipe.

Figure 2:
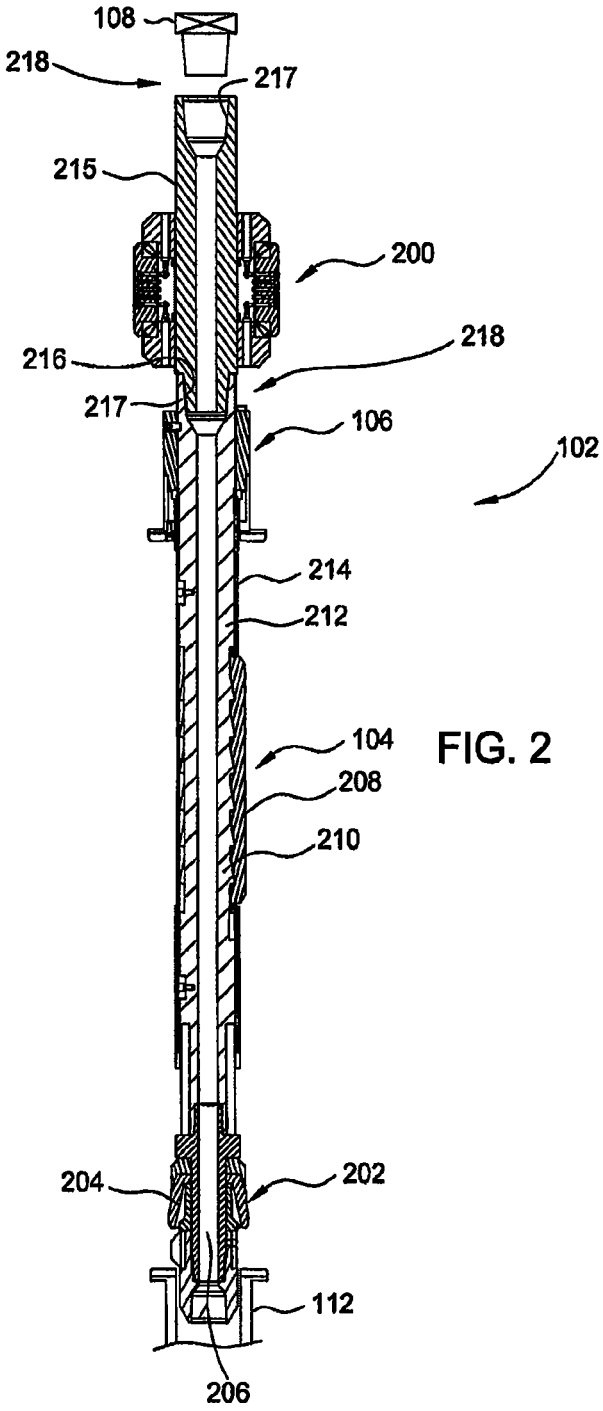
FIG. 2 is a schematic of a gripping member according to one embodiment described herein.

FIG. 2 shows a schematic view of the tubular handling system 102 according to one embodiment. The tubular handling system 102 includes a swivel 200, a pack off 202, in addition to the drive mechanism 108, the actuator 106, and the gripping apparatus 104.

The gripping apparatus 104, as shown in FIG. 2, is an internal gripping device adapted to engage the interior of the tubular 112. The gripping apparatus 104 includes a set of slips 208, a wedge lock 210, and a mandrel 212 coupled to the actuator 106. The slips 208 may be any slip or gripping member adapted to grip the tubular 112, preferably the slips 208 have wickers (not shown) in order to provide gripping engagement. The wedge lock 210 is coupled to mandrel 212, which may be coupled to the actuator 106. The actuator 106 moves a sleeve 214, or cage, down in order to move the slips 208 down. As the slips 208 move down, the angle of the slips 208 and the angle of the wedge lock 210 moves the slips 208 radially away from a longitudinal axis of the gripping apparatus 104. This outward radial movement moves the slips 208 into engagement with the tubular 112. With the slips 208 engaged with the tubular 112, the weight of the tubular 112 will increase the gripping force applied by the slips 208 due to the angles of the wedge lock 210 and the slips 208. Although FIG. 2 shows the sleeve 214 moving down in order to actuate the slips 208, any suitable configuration may be used in order to engage the slips 208 with the tubular 112. In another embodiment, the slips 208 actuate by moving the wedge lock 210 up relative to the slips 208, thus forcing the slips 208 to move radially outward.

In an alternative embodiment, the gripping apparatus 104 may be an external gripper for gripping the exterior of the tubular 112. The external gripper may incorporate slips which move toward the longitudinal axis when actuated. Further, a combination of an internal and external gripping apparatus 104 may be used. Further still, the external gripper may incorporate gripping members which pivot in order to engage the tubular. An exemplary external gripper is show in U.S. Patent Application Publication No. 2005/0257933, which is herein incorporated by reference in its entirety.

The actuator 106 is shown schematically in FIGS. 1 and 2 and may be an electrical, mechanical, or fluid powered assembly designed to disconnect and to set the gripping apparatus 104. Further, the actuator 106 may be any combination of electrical, mechanical, or fluid powered actuators.

Figure 3:
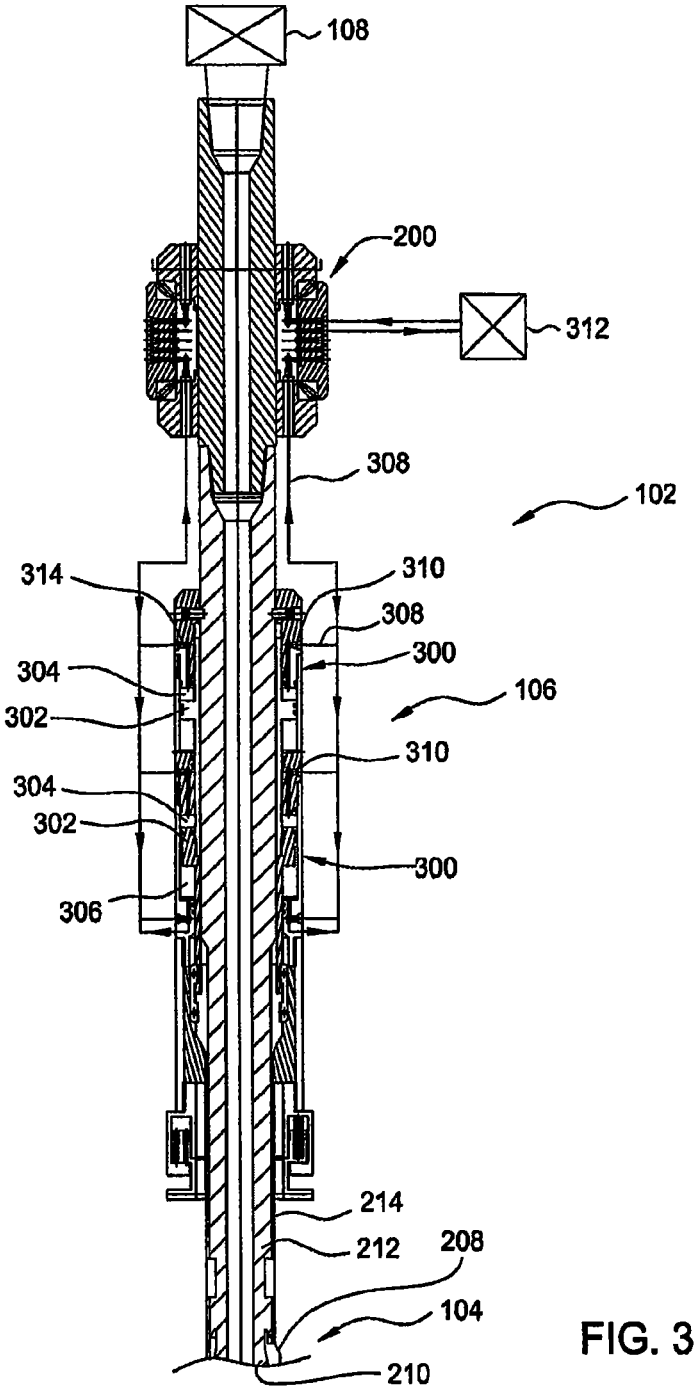
FIG. 3 is a schematic of a gripping member according to one embodiment described herein.

The swivel 200 allows an electrical or fluid source such as a pump (not shown) to transmit a fluid and/or electric current to the actuator 106 during operation, especially during rotation of the actuator 106. The swivel 200 may be a conventional swivel such as a SCOTT ROTARY SEAL™ with conventional o-ring type seals. The swivel 200, in FIGS. 2 and 3 is part of a sub 215, which has a lower pin end 216 and an upper box end 217 for coupling the swivel 200 to other rig components such as a top drive or the mandrel 212. The upper end of the mandrel 212 may have an adapter 218, optional, for connecting the gripping apparatus 104 to the swivel 200 or the drive mechanism 108. The adapter 218 may simply be a threaded connection as shown or incorporate a locking feature which will be described in more detail below. The drive mechanism 108 may be any drive mechanism known in the art for supporting the tubular 112 such as a top drive, a compensator, or a combined top drive compensator, or a traveling block. The connection between the drive mechanism 108 and the gripping apparatus 104 may be similar to the adapter 218 and will be discussed in more detail below. The mandrel 212 is configured such that the top drive will transfer a rotational motion to the slips 208, as discussed in more detail below.

The actuator 106 may be coupled to the mandrel 212 and operatively coupled to the swivel 200. The swivel 200 may generally be a hollow or solid shaft with grooves or contact rings and an outer ring having fluid ports or brushes. The shaft is free to rotate while the ring is stationary. Thus, the fluid is distributed from a stationary point to a rotating shaft where, in turn the fluid is further distributed to various components to operate the equipment rotating with the mandrel 212, such as the actuator 106 to set and release the slips 208.

In one embodiment, the actuator 106 is two or more annular piston assemblies 300, as shown in FIG. 3. Each annular piston assembly 300 may include a piston 302, a fluid actuation chamber 304, a control line(s) 308 (shown schematically), and a fluid inlet 310. Each annular piston assembly 300 is capable of actuating the gripping apparatus 104 independently of the other piston assemblies 300. Thus, there is a built in redundancy to provide a back up safety system. That is, one of the annular piston assemblies 300 is a primary assembly which is necessary to operation of the actuator 106. The remaining annular piston assemblies 300 are redundant and provide an additional backup safety feature. Each annular piston assembly 300 operates by introducing fluid into the fluid actuation chamber 304. The fluid in the actuation chamber 304 applies pressure to the upper side of the piston 302. The pressure on the piston 302 moves the piston 302 down. The piston 302 is operatively coupled to the gripping apparatus 104 via the sleeve 214. Although shown as coupled to the sleeve 214, it should be appreciated that any form of actuating the gripping apparatus 104 with the pistons 302 is contemplated. In order to release the gripping apparatus 104 from the tubular 112, fluid may be introduced into a release chamber 306. When the fluid pressure in the release chamber 306 acting on the lower side of the piston 302 is greater than the fluid pressure above the piston 302, the piston 302 may move up thereby releasing the gripping apparatus 104 from the tubular 112. Each of the annular piston assemblies 300 may have the release chamber 306 or none may be equipped with the release chamber. It is contemplated that in order to release the gripping apparatus 104 the pressure in the actuation chambers 304 is simply relieved, the drive mechanism 108 may then be used to release the slips 208, shown in FIG. 2 from the tubular 112. Although shown as having two annular piston assemblies 300, it should be appreciated that any number may be used so long as there is at least one primary piston assembly and one redundant or backup piston assembly.

The control lines 308, shown schematically in FIG. 3, may be one control line or a series/plurality of control lines for supplying fluid to each individual annular piston assembly 300. The control lines 308 may include a monitor line to transmit information back to a controller 312. The control lines 308 allow an operator or the controller 312 to monitor the conditions in the fluid chambers in each individual annular piston assembly 300, including but not limited to pressure and temperature. Thus, if there is a sudden loss of pressure in one of the annular piston assemblies 300, the controller 312 or the operator may make adjustments to the other annular piston assemblies 300 to ensure that engagement with the tubular 112 is not lost. The control lines 308, although shown as a control line, may be any fluid source known in the art such as an annulus surrounding the actuator 106.

Generally, the controller 312 may have additional control lines operatively communicating with a traveling block, a location system, a sensor, the drive mechanism, a power tong, and/or a pipe handling apparatus. Further, the controller 312 receives data from the monitor lines and the drive mechanism. The controller 312 in various embodiments may be in fluid, wireless (e.g., infrared, RF, Bluetooth, etc.), or wired communication with components of the present invention. Illustratively, the controller 312 may be communicatively coupled to the drive mechanism, fluid chambers, gripping apparatus 104, a release, a location system, one or more sensors, and other drilling rig components. The controller 312 may generally be configured to operate and monitor each of the respective components in an automated fashion (e.g., according to a preprogrammed sequence stored in memory) or according to explicit user input.

Although not shown, the controller 312 may be equipped with a programmable central processing unit, a memory, a mass storage device, and well-known support circuits such as power supplies, clocks, cache, input/output circuits and the like. Once enabled, an operator may control the operation of the gripping apparatus 104 by inputting commands into the controller 312. To this end, another embodiment of the controller 312 includes a control panel, not shown. The control panel may include a key pad, switches, knobs, a touch pad, etc.

With the controller 312 monitoring and operating the drilling rig, an integrated safety system may easily be adapted to the drilling rig 100. A safety system may prevent dropping a tubular 112 or tubular string 116. In one embodiment, the safety system is adapted to provide an indication of whether the gripping apparatus 104 is properly connected to the tubular 112. Thus, the safety system would allow an operator or the controller 312 to know that the gripping apparatus 104 has fully engaged the tubular 112. When engagement of the gripping apparatus 104 to the tubular 112, which is now a part of the tubular string 116, is confirmed by the safety system, the controller 312 or operator may release the slips or spider at the rig floor 118. The traveling block would then lower the tubular string 116 so that the box end of the tubular is located near the rig floor 118. The controller 312 or operator may then re-activate the slips or spider to grip the tubular string 116. With the slips engaging the tubular string 116, the controller 312 would allow the gripping apparatus 104 to release the tubular string 116. The safety system is also capable of monitoring the proper amount of torque in the threads of the tubulars 112 during make up. This ensures that the threads are not damaged during make up and that the connection is secure. Examples of suitable safety systems are illustrated in U.S. Pat. No. 6,742,596 and U.S. Patent Application Publication Nos. U.S. 2005/0096846, 2004/0173358, and 2004/0144547, which are herein incorporated by reference in their entirety.

Figure 4:
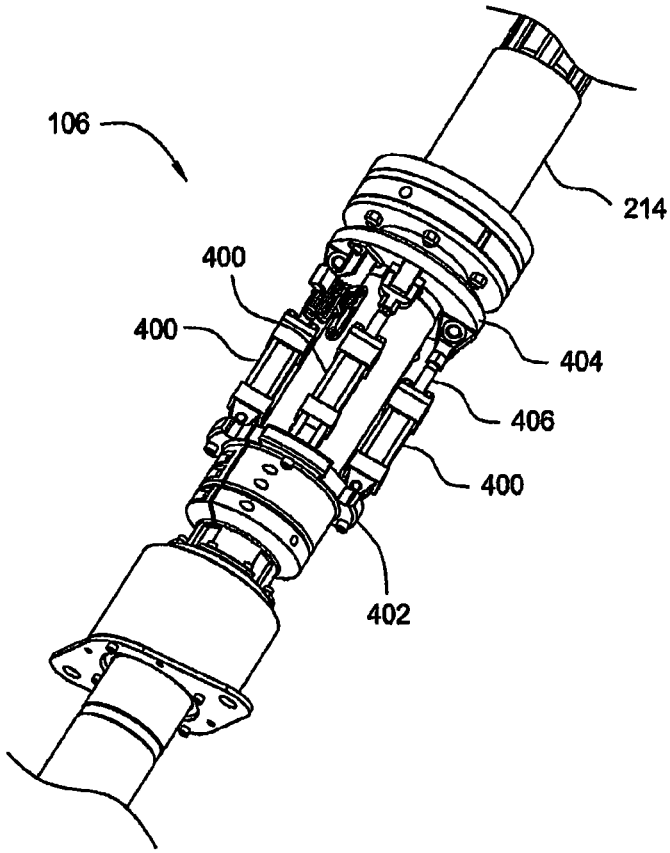
FIG. 4 is a schematic of an actuator for a gripping member according to one embodiment described herein.

In an alternative embodiment, the actuator 106 of the gripping apparatus 104 includes one or more piston and cylinder assemblies 400, as shown in FIG. 4. The piston and cylinder assemblies 400 couple to the mandrel 212 via a collar 402, and are moveably coupled to the sleeve 214 via a slip ring 404. The slip ring 404 couples to a rod 406 of each of the piston and cylinder assemblies 400. The slip ring 404 is operatively coupled to the sleeve 214 in order to actuate the gripping apparatus 104. It should be appreciated that any method known in the art of fixing the piston and cylinder assemblies 400 to the mandrel 212 and the sleeve 214 may be used. Any one of the piston and cylinders assemblies 400 are capable of moving the slip ring 404 in order to actuate the gripping apparatus 104, therefore, all but one of the piston and cylinder assemblies 400 is redundant or provide a backup, and one of the pistons is the primary actuator. It should further be appreciated that other power sources besides fluid sources may also be employed to power the gripping apparatus 104 either separately or in conjunction with the fluid power. These alternative power sources include, but are not limited to, electric, battery, and stored energy systems such as power springs and compressed gas.

In another embodiment, the actuator 106 may be electrically powered. The electrically powered actuator may be equipped with a mechanical locking device, which acts as a backup assembly, which prevents release of the gripping apparatus 104. Further, the electrically powered actuator may include more than one actuation member for redundancy or as a backup. Further still, the electrically powered actuator may send data to a controller 312 to communicate its position to an operator. Thus, if one lock fails, the controller 312 may take steps to prevent the accidental release of the tubular 112.

As described above, in order to provide for redundancy or a backup safety assembly, a separately operable redundant actuator may be used to ensure operation of the gripping apparatus 104 in the event of failure of the primary actuator. In one embodiment, as shown in FIG. 3, the actuator 106 includes four the annular piston assemblies 300. The primary actuator may be one of the annular piston assemblies 300, while anyone or all of the remaining annular piston assemblies 300 may act as the redundant actuator. The redundant actuator acts in the same manner as the primary actuator. That is, the redundant actuator applies an actuation force to the gripping apparatus 104 when fluid is supplied to the actuation chamber 304 of the redundant actuator. As discussed above, the fluid pressure in the actuation chamber 304 may be monitored by the controller 312. The redundant actuator will provide the actuation force upon the gripping apparatus 104 even in the event of a primary actuator failure. Further, additional redundant actuators may be provided which are operated in the same or a similar manner as the redundant actuator.

In another embodiment, one or more valves 314, shown schematically in FIG. 3, are disposed between the control line(s) 308 and the actuation chamber 304 to provide the additional and/or alternative backup safety assembly. The valve 314 allows fluid to enter the actuation chamber 304, but does not allow fluid to exit the actuation chamber 304. The valves 314 may be set to release the pressure when the release chambers 306 are actuated. The valve 314 is typically a one way valve such as a check valve; however, it should be appreciated that any valve may be used including, but not limited to, a counter balance valve. In operation, the fluid enters the actuation chamber 304 and actuates the annular piston assembly 300 thereby engaging the tubular 112 with the slips 208 of the gripping apparatus 104. The fluid also acts redundantly to prevent the slips 208 of the gripping apparatus 104 from disengaging with the tubular 112 until pressure is applied on the opposite end of the piston 302. In this embodiment, the valve 314 acts to maintain a substantially constant pressure on the piston 302, even if fluid pressure is inadvertently lost in the control line(s) 308 or selectively turned off. This in turn keeps a constant locking force on the slips 208. The valves 314 may be built into the actuator 106 or added and/or plumbed in as an add-on to the actuator 106. Further, the valve 314 may be located anywhere between the fluid source for operating the annular piston assembly 300 and the actuation chamber 304. The valve 314 may be attached to each actuation chamber 304 or any number of fluid chambers depending on the requirements of the actuator 106. Thus, in operation only one of the actuation chamber 304 is necessary to engage the slips 208. The additional actuation chambers 304 may be equipped with the valve 314 as a safety chamber that once actuated prevents the gripping apparatus 104 from accidentally releasing the tubular 112. The valves 314 will work on a single piston basis. Thus, if multiple pistons are used and if one piston is lost or leaks off pressure due to a failed seal, the redundant actuator will continue to hold the setting force on the slips 208.

In yet another alternative embodiment, the redundant actuator is one or more of the piston and cylinder assemblies 400, and the primary actuator is one of the piston and cylinder assemblies 400, as shown in FIG. 4. As described above, the primary actuator and each of the redundant actuators are capable of independently operating the gripping apparatus 104. Further, the controller 312, shown in FIG. 3, is capable of monitoring conditions in the primary actuator and the redundant actuators in order to ensure that gripping apparatus 104 remains engaged with the tubular 112 when desired.

Figure 5:
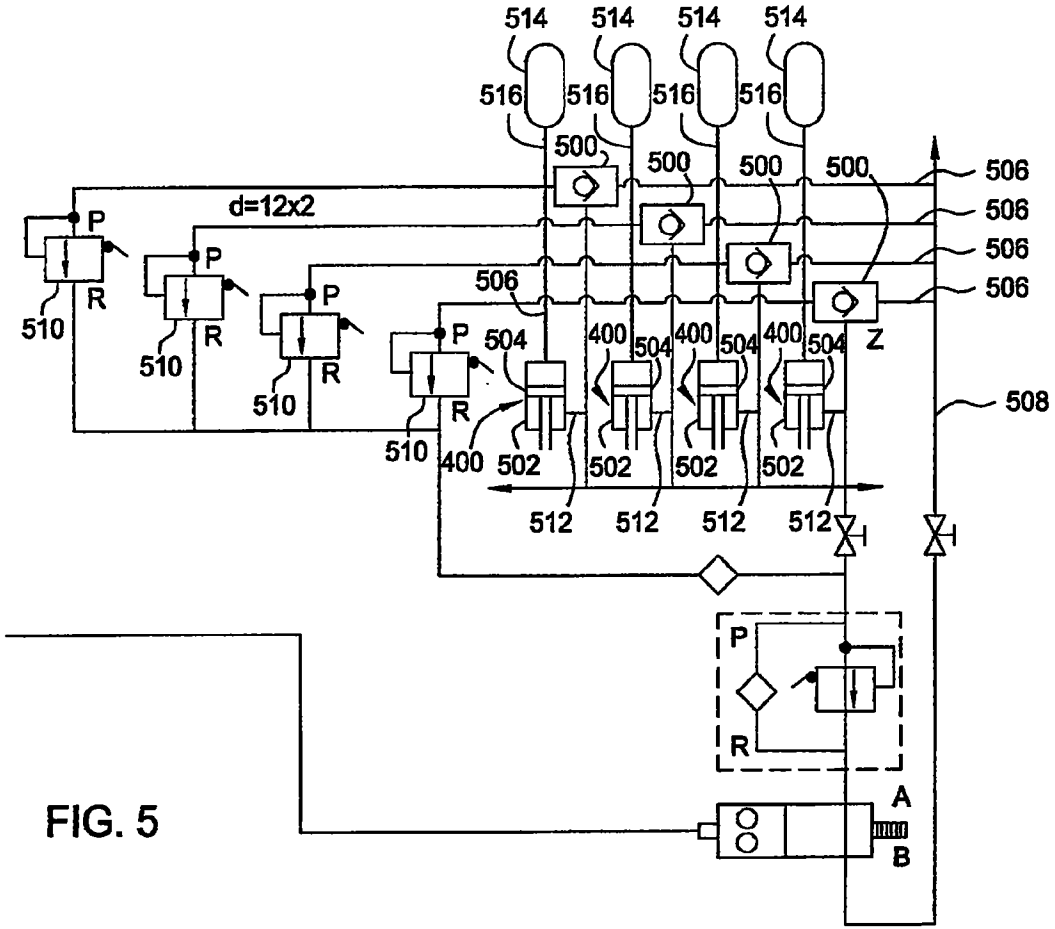
FIG. 5 is a schematic of a hydraulic actuator according to one embodiment described herein.

In yet another embodiment, at least some of the piston and cylinder assemblies 400 are equipped with a valve 500, shown schematically in FIG. 5, in order to provide the backup assembly as an additional safety feature to prevent inadvertent release of the gripping apparatus 104. As shown, each of the piston and cylinder assemblies 400 includes a cylinder 502 and a piston 504. There may be two fluid control lines connected to each of the piston and cylinder assemblies 400. An actuation line 506 connects to each cylinder 502. The actuation line 506 applies hydraulic or pneumatic pressure to each piston 504 in order to actuate the gripping apparatus 104 (shown in FIGS. 1-4). A release line 512 connects to each of the cylinders 502 below the piston 504 in order to release the gripping apparatus 104. A one or more feed lines 508 may couple to each of the actuation lines 506. Further, separate feed lines may be used in order to power each of the piston and cylinder assemblies 400 separately. Each of the actuation lines 506 may be equipped with the valve 500, although shown as each of the actuation lines 506 having the valve 500, it should be appreciated that as few as one valve 500 may be used.

To activate the gripping apparatus 104, fluid flows through the one or more feed lines 508. The fluid enters each of the actuation lines 506, then flows past the valves 500. The valves 500 operate in a manner that allows fluid to flow toward the cylinder 502, but not back toward the feed line 508. As the fluid continues to flow past the valves 500, it fills up each of the lines downstream of the valves 500. The fluid may then begin to exert a force on the pistons 504. The force on the pistons 504 causes the pistons 504 to move the slip ring 404 (shown in FIG. 4) and actuate the gripping apparatus 104. The slips 208 will then engage the tubular 112. With the slips 208 fully engaged, the fluid will no longer move the pistons 504 down. Introduction of fluid may be stopped at a predetermined pressure, which may be monitored by the controller 312 or an operator. The only force on the pistons 504 in the actuated position is the fluid pressure above the pistons 504. The system will remain in this state until the pressure is released by switches 510 or the valves 500 or in the event of system failure. Each of the valves 500 acts as a safety system to ensure that the gripping apparatus 104 does not inadvertently release the tubular 112. In operation, the slips 208 may be released by actuating the switches 510 and allowing fluid to leave the top side of the pistons 504. Fluid is then introduced into release lines 512 in order to pressurize the bottom side of the pistons 504. With the fluid released above the piston 504, there is no additional force required to release the slips 208 other than friction between the slips 208 and tubular 112. Although the valves 500 are shown in conjunction with the piston and cylinder assemblies 400, it should be appreciated that the valves 500 and hydraulic scheme may be used in conjunction with any actuator disclosed herein.

In yet another alternative embodiment, one or all of the piston and cylinder assemblies 400 may be equipped with an accumulator 514, optional, shown in FIG. 5. The accumulator 514 provides an additional safety feature to ensure that the gripping apparatus 104 does not release the tubular 112 prematurely. The accumulator 514, as shown, is between the valve 500 and the cylinder 502, within each of the actuation lines 506. An accumulator line 516 fluidly couples the accumulator 514 to the actuation lines 506. Each accumulator 514 may include an internal bladder or diaphragm (not shown). The bladder is an impermeable elastic membrane that separates the piston and cylinder assemblies 400 system fluid from the compressible fluid in the accumulator 514. Before operating the piston and cylinder assemblies 400 system fluid, the accumulator 514 is filled with compressible fluid to a predetermined pressure. With the compressible fluid pressure only in the accumulator 514, the bladder will expand to cover the lower end towards the accumulator line 516 of the accumulator 514. With the bladder in that position, the accumulator bladder has reached maximum expansion. When the fluid for operating the piston and cylinder assemblies 400 enters the accumulators 514, the membrane of the bladder begins to move up relative to the accumulator lines 516. The bladder compresses the compressible fluid further as the bladder moves up in the accumulators 516. With the slips 208 fully engaged, the fluid will no longer move the pistons 504 down. The system fluid will continue to expand the bladder while compressing the compressible fluid in the accumulators 514. Introduction of system fluid will be stopped at a predetermined pressure. As discussed above, the system may remain in this state until the pressure is released by switches 510 or in the event of system failure.

In the event that the hydraulic system leaks, the system will slowly begin to lose its system fluid. However, the compressible fluid in the accumulators 514 maintains the pressure of the system fluid by adding volume as the system fluid is lost. As the compressible fluid expands, the bladder expands, thus maintaining the pressure of the system fluid by adding volume to the system. The expansion of the bladder is relative to the amount of system fluid lost. In other words, the pressure of the system fluid and in turn the pressure on the piston 504 remains constant as the system fluid is lost due to the expansion of the bladder. The bladder continues to move as the system fluid leaks out until the bladder is fully expanded. Once the bladder has fully expanded, any further leaking of the system fluid will cause a loss of pressure in the system. The pressure in the accumulators 514 may be monitored by the controller 312. Thus, upon loss of pressure in the accumulators 514, the controller 312 or an operator may increase the pressure in the piston and cylinder assemblies 400 thereby preventing inadvertently releasing the gripping apparatus 104. Each of the valves 500 and accumulators 514 act independently for each of the piston and cylinder assemblies 400. Therefore, there may be one primary piston having a valve 500 and an accumulator 514 and any number of redundant pistons having a valve 500 and an accumulator 514, thereby providing an increased factor of safety. The accumulators 514 may be used with any actuator described herein.

Figure 6:
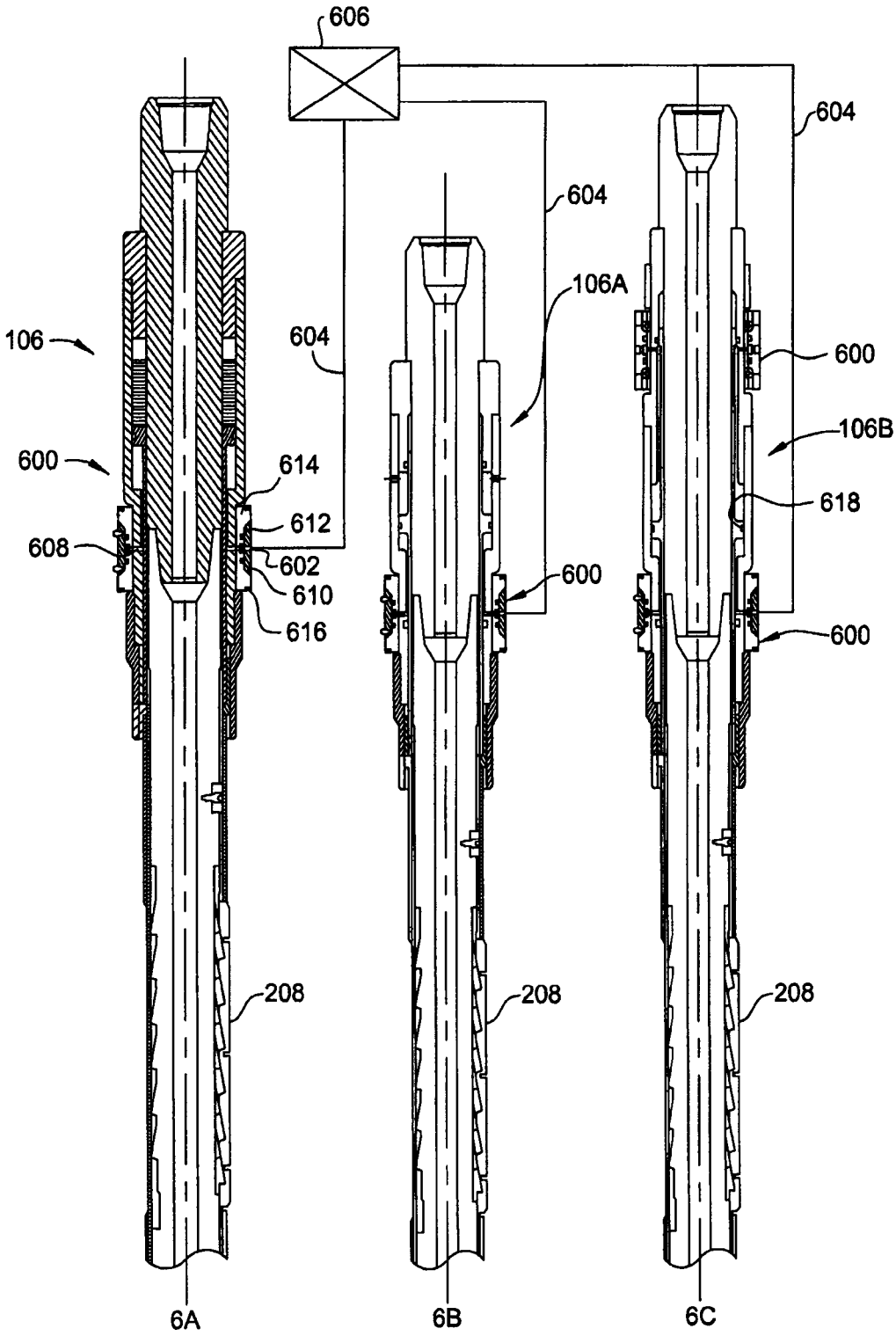
FIGS. 6A-6C show a schematic of a gripping member according to one embodiment described herein.
FIG. 6D shows a cross sectional view of a swivel according to an alternative embodiment.

In an alternative embodiment to the swivel 200 discussed above, a swivel 600 couples directly to the actuator 106, as shown in FIG. 6A. This reduces the overall length of the gripping apparatus 104 by not requiring the sub 215. The swivel 600 has a fluid nozzle 602 which attaches to a control line 604 coupled to a fluid or electrical source 606 (shown schematically). The swivel 600 additionally has a fluid chamber 180 which is in communication with the actuator 106 via a port 608, for releasing or engaging the slips 208. The swivel 600 contains a housing 610, which may comprise the fluid nozzle 602, two or more seal rings 612, and a base 614, which is connected directly to the rotating member. Further, the swivel 600 includes slip rings 616, which couple the housing 610 to the base 614 while allowing the housing 610 to remain stationary while the base 614 rotates. FIG. 6B shows the swivel 600 coupled to an actuator 106A according to an alternative embodiment. FIG. 6C shows two swivels 600 attached to an actuator 106B. The actuator 106B has a piston 618 which moves up by fluid introduced from the lower swivel 600 and moves down by fluid introduced from the upper swivel 600. The piston 618 operates the gripping apparatus 104. It should be appreciated that the swivels 600 may be used with any actuator 106 arrangement disclosed herein or known in the art. Further, any number of swivels 600 may be used.

In yet another alternative embodiment, the redundancy for any of the actuators described above may be achieved by a primary fluid system with an electrically powered backup. Further the primary system may be electrically powered and the redundant system may be fluid operated.

Figure 6D:
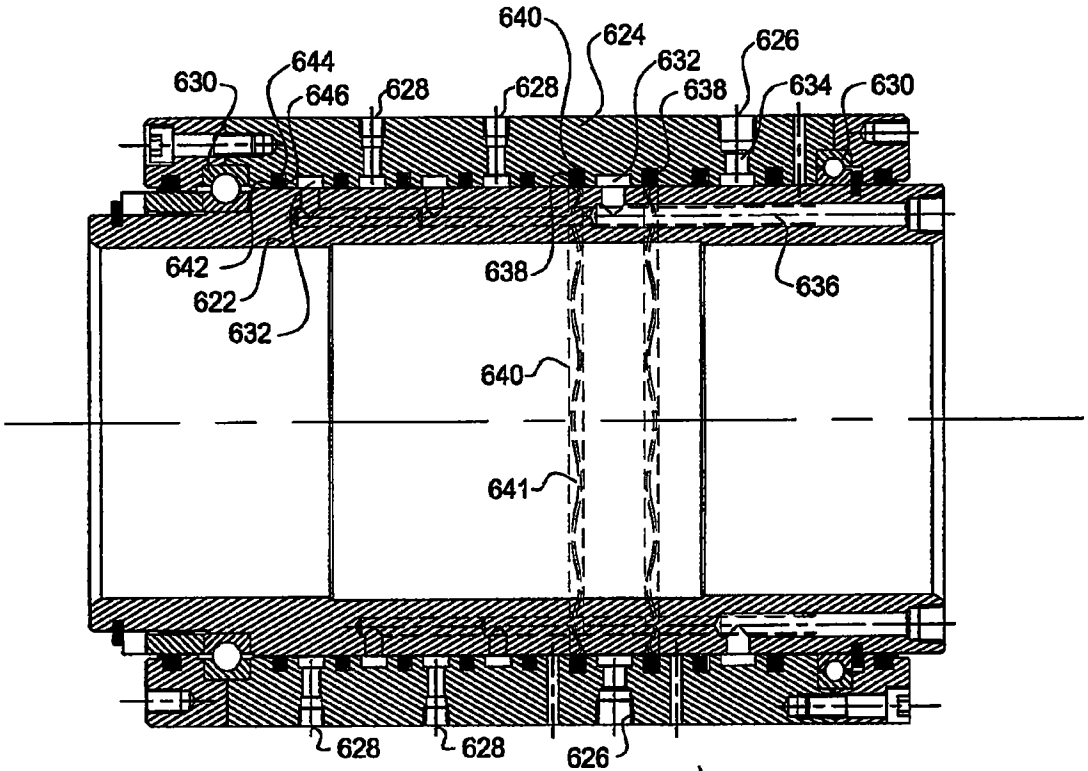

In yet another alternative embodiment, the swivel 200 and/or 600 described above may be in the form of a rotating union 620, as shown in FIG. 6D. The rotating union 620 includes an inner rotational member 622 and an outer stationary member 624. The inner rotational member 622 may be coupled to the rotating components of the tubular handling system 102, such as the drive mechanism 108 and the actuator 106. The outer stationary member 624 is adapted to couple to one or more control lines for operating the tubular handling system 102 components. As shown the rotating union 620 includes two hydraulic fluid inlets 626 and four pneumatic fluid inlets 628; however, it should be appreciated any combination of pneumatic fluid, hydraulic fluid, electric, and fiber optic inlet may be used, including only one hydraulic fluid inlet 626 and/or one pneumatic fluid inlet 628. The inlets 626 and 628 may optionally include a valve for controlling flow. A bearing 630 may be included between the inner rotational member 622 and the outer stationary member 624 in order to bear radial and axial forces between the two members. As shown the bearing 630 is located at each end of the outer stationary member 624.

The hydraulic fluid inlet 626 fluidly couples to an annular chamber 632 via a port 634 through the outer stationary member 624. The annular chamber 632 encompasses the entire inner diameter of the outer stationary member 624. The annular chamber 632 fluidly couples to a control port 636 located within the inner rotational member 622. The control port 636 may be fluidly coupled to any of the components of the tubular handling system 102. For example, the control port 636 may be coupled to the actuator 106 in order to operate the primary actuator and/or the redundant actuator.

In order to prevent leaking between the inner rotational member 622 and the outer stationary member 624, a hydrodynamic seal 638 may be provided at a location in a recess 640 on each side of the annular chamber 632. As shown, the hydrodynamic seal 638 is a high speed lubrication fin adapted to seal the increased pressures needed for the hydraulic fluid. The hydrodynamic seal 638 may be made of any material including but not limited to rubber, a polymer, an elastomer. The hydrodynamic seal 638 has an irregular shape and/or position in the recess 640. The irregular shape and/or position of the hydrodynamic seal 638 in the recess 640 is adapted to create a cavity 641 or space between the walls of the recess 640 and the hydrodynamic seal 638. In operation, hydraulic fluid enters the annular chamber 632 and continues into the cavities 641 between the hydrodynamic seal 638 and the recess 640. The hydraulic fluid moves in the cavities as the inner rotational member 622 is rotated. This movement circulates the hydraulic fluid within the cavities 641 and drives the hydraulic fluid between the hydrodynamic seal contact surfaces. The circulation and driving of the hydraulic fluid creates a layer of hydraulic fluid between the surfaces of the hydrodynamic seal 638, the recess 640 and the inner rotational member 622. The layer of hydraulic fluid creates lubricates the hydrodynamic seal 638 in order to reduce heat generation and increase the life of the hydrodynamic seal. In an alternative embodiment, the hydrodynamic seal 638 is narrower than the recess 640 while having a height which is substantially the same or greater than the recess 640. The hydrodynamic seal 638 may also be circumferentially longer than the recess. This configuration forces the hydrodynamic seal 638 to bend and compress in the recess as shown in the form of the wavy hidden line on FIG. 6D. When rotated, the hydraulic fluid circulates in the cavities 641 as described above. Each of the inlets may include the hydrodynamic seal 638. Each of the inlets may have the control port 636 in order to operate separate tools of any of the components of the tubular handling system 102.

A seal 642 may be located between the inner rotational member 622 and the outer stationary member 624 at a location in a recess 640 on each side of the annular chamber 632 of the pneumatic fluid inlets 628. The seal 642 may include a standard seal 644 on one side of the recess and a low friction pad 646. The low friction pad may comprise a low friction polymer including but not limited to Teflon™ and PEEK™. The low friction pad 646 reduces the friction on the standard seal 644 during rotation. Any of the seals described herein may be used for any of the inlets 626 and/or 628.

Figure 7:
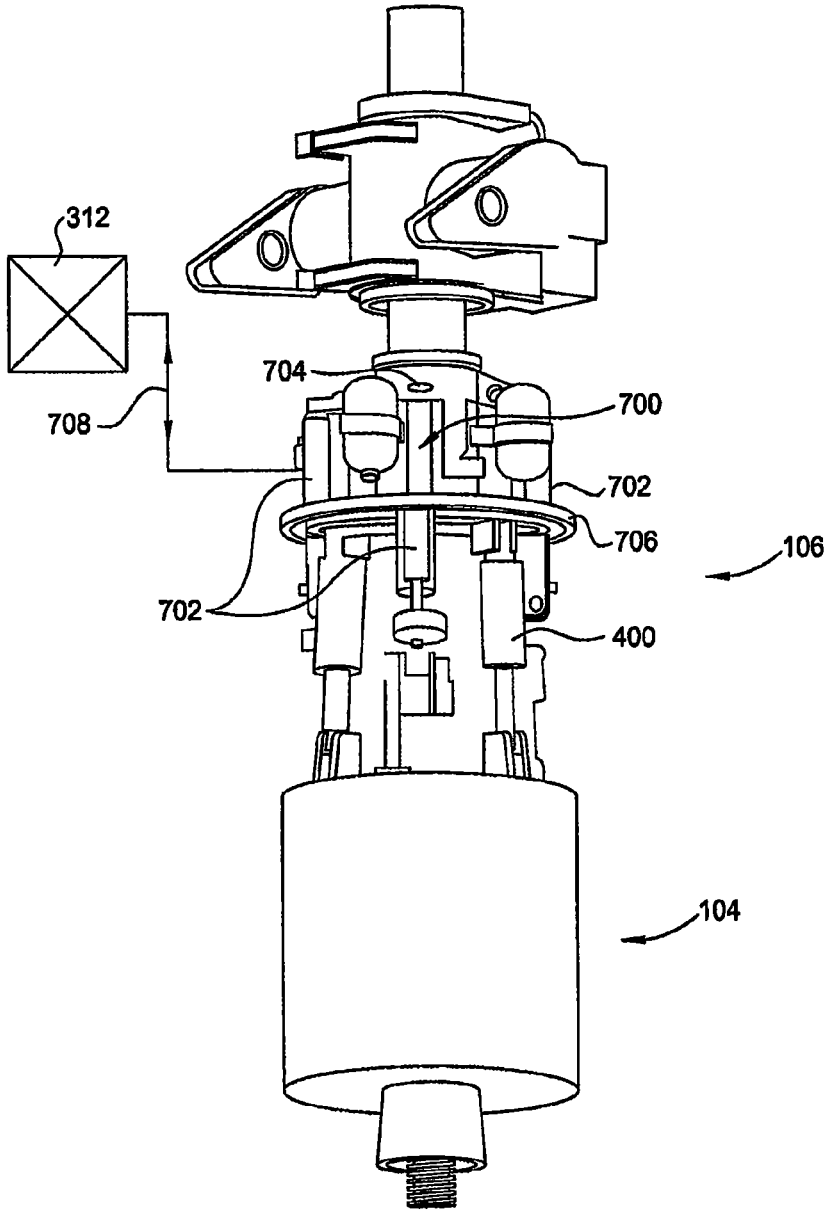
FIG. 7 is a schematic of a hydraulic actuator according to one embodiment described herein.

The tubular handling system 102 may include a compensator 700, as shown in FIG. 7. The compensator 700 compensates for the length loss due to thread make-up without having to lower the drive mechanism 108 and/or top drive during the connection of the tubular 112 with the tubular string 116. This system not only allows for length compensation as the thread is made up, it also controls the amount of weight applied to the thread being made up so that excessive weight is not applied to the thread during make up. The compensator 700, as shown, consists of one or more compensating pistons 702 which are coupled on one end to a fixed location 704. The fixed location 704 may couple to any part of the tubular handling system 102 that is longitudinally fixed relative to the tubulars 112. The fixed location 704, as shown, is coupled to the top drive. The other end of the compensating pistons 702 are operatively coupled to the piston and cylinder assemblies 400 via a coupling ring 706. The piston and cylinder assemblies 400 are coupled to the gripping apparatus 104 as described above. The compensating pistons 702 are adapted to remain stationary until a preset load is reached. Upon reaching the load, the compensator pistons will allow the coupling ring 706 to move with the load, thereby allowing the gripping apparatus 104 to move.

In operation, the gripping apparatus 104 grips the tubular 112. With only the tubular 112 coupled to the gripping apparatus 104, the compensator piston 702 will remain in its original position. The tubular 112 will then engage the tubular string 116, shown in FIG. 1. The drive mechanism 108 will then rotate the tubular 112 in order to couple the tubular 112 to the tubular string 116. As the threaded coupling is made, an additional load is applied to the gripping apparatus 104 and thereby to the compensating pistons 702. The compensator pistons 702 will move in response to the additional load thereby allowing the gripping apparatus 104 to move longitudinally down as the threaded connection is completed. Although the compensator 700 is shown with the piston and cylinder assemblies 400, it should be appreciated that the compensator 700 may be used in conjunction with any actuator described herein.

The compensator pistons 702 may be controlled and monitored by the controller 312 via a control line(s) 708. The control line(s) 708 enables the pressure in the compensating pistons 702 to be controlled and monitored in accordance with the operation being preformed. The controller 312 is capable of adjusting the sensitivity of the compensator pistons 702 to enable the compensator pistons to move in response to different loads.

In another embodiment, the compensator 700 is simply a splined sleeve or collar, not shown. The splined sleeve allows for longitudinal slip or movement between the drive mechanism 108 and the gripping apparatus 104. In yet another embodiment, the compensator may include a combination of pistons and the splined sleeve.

Figure 8E:
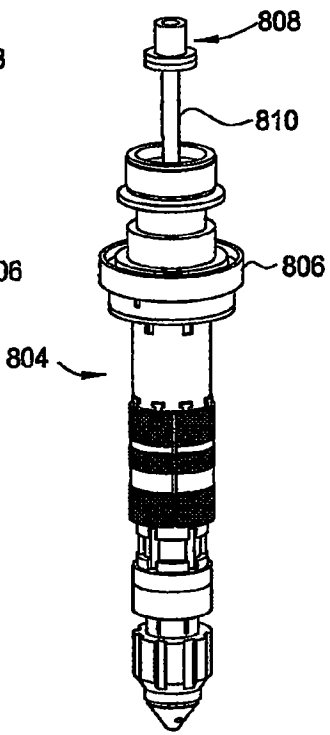
FIGS. 8B-8E show a schematic of multiple gripping members according to one embodiment described herein.
Figure 8D:
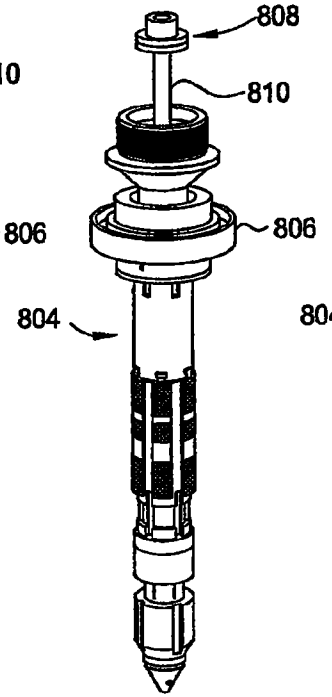
Figure 8C:
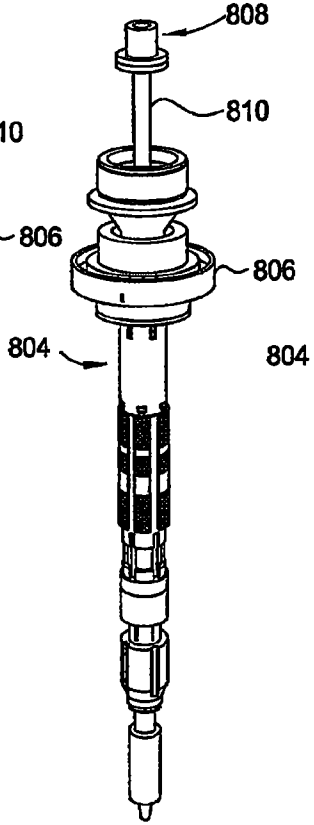
Figure 8B:
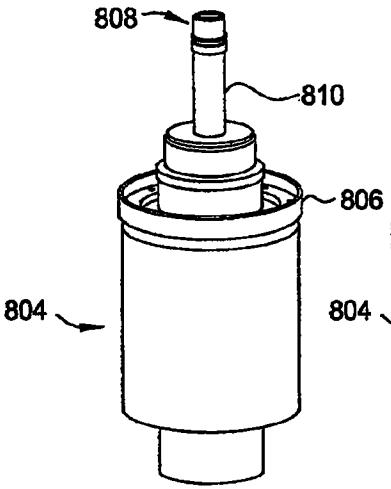
Figure 8A:
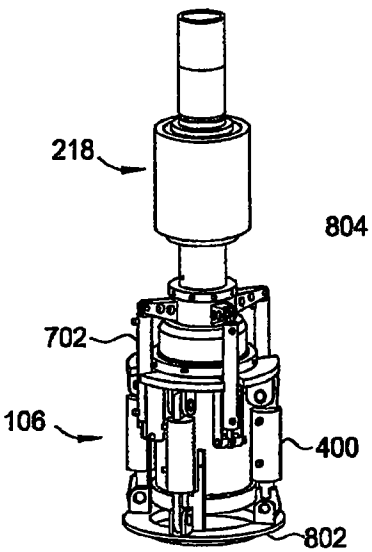
FIG. 8A is a schematic of a hydraulic actuator according to one embodiment described herein.

The actuator 106 may be adapted for interchangeable and/or modular use, as shown in FIGS. 8A-8E. That is, one actuator 106 may be adapted to operate any size or variety of a modular gripping apparatus 804. FIG. 8A shows the actuator 106 having the piston and cylinder assemblies 400, one or more compensator pistons 702, and an adapter 218 for coupling the actuator 106 to the drive mechanism 108 (shown in FIG. 1). The adapter 218 may include a torque sub in order to monitor the torque applied to the tubular 112. FIGS. 8B-8E show various exemplary modular gripping apparatus 804 that may be used with the actuator 106. Actuation of the selected gripping apparatus 804 is effected using a modular slip ring 802. The modular slip ring 802, which is similar to slip ring 404 described above, couples to the piston and cylinder assemblies 400 and is movable therewith, as described above. The modular slip ring 802 is adapted to couple to a mating slip ring 806 of the modular gripping apparatus 804. When coupled to the mating slip ring 806, the modular slip ring 802 may actuate the gripping apparatus 104 as described above. In this respect, the slip rings 802 and 806 move in unison in response to actuation of the piston and cylinder assemblies 400, which, in turn, causes engagement or disengagement the gripping apparatus 104 from the tubular 112. Torque from the drive mechanism 108 may be transferred to the modular gripping apparatus 804 using a universal couple 808. As show, the universal couple 808 is positioned at the end of a rotational shaft 810 for each modular gripping apparatus 804. The universal couple 808 is adapted to couple to a shaft within the actuator 106. With the universal couple 808 coupled to the shaft of the actuator 106, rotation may be transferred from the drive mechanism 108 to the rotational shaft 810 and in turn to the tubular via the modular gripping apparatus 804.

In operation, the modular aspect of the tubular handling system 102 allows for quick and easy accommodation of any size tubular 112 without the need for removing the actuator 106 and/or the drive mechanism 108. Thus, the external modular gripping apparatus 804, shown in FIG. 8B, may be used initially to grip, couple, and drill with the tubular. The external modular gripping apparatus 804 may then be removed by uncoupling the slip ring 806 from slip ring 802. The internal gripping apparatus 804, shown in FIG. 8E, may then be used to continue to couple, run, and drill with tubulars 112. It is contemplated that gripping apparatus of any suitable size may be used during operations. Further, any of the actuators 106 described herein may be used in conjunction with the modular gripping apparatus 804.

Figure 9A:
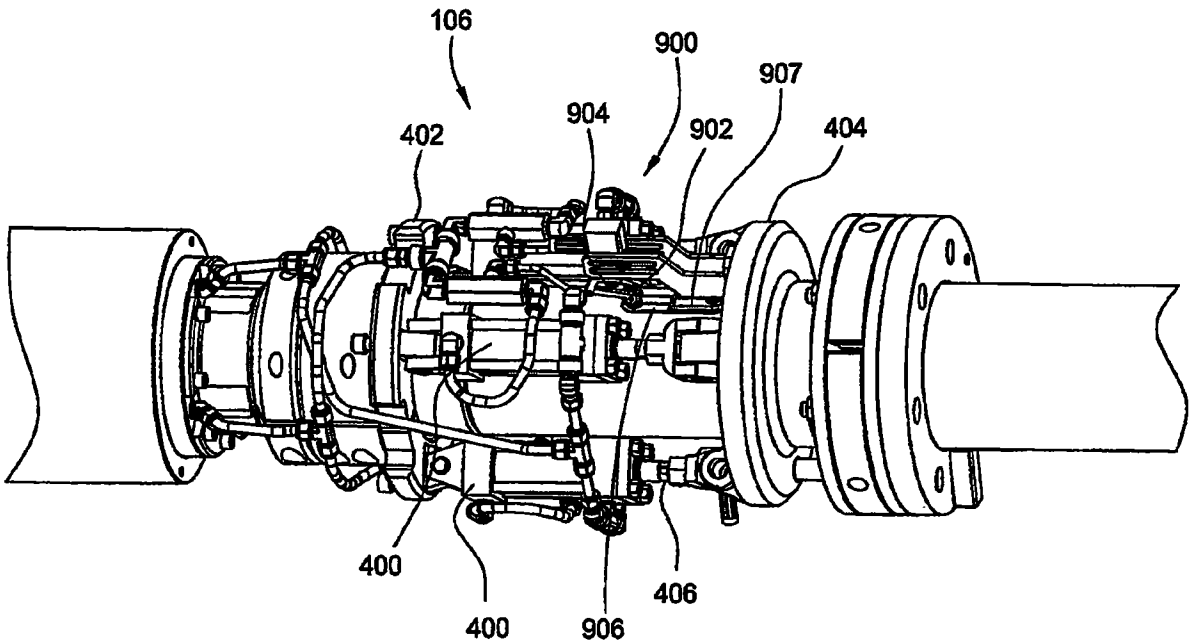
FIGS. 9A-9B show a schematic of a location system according to one embodiment described herein.
Figure 9B:
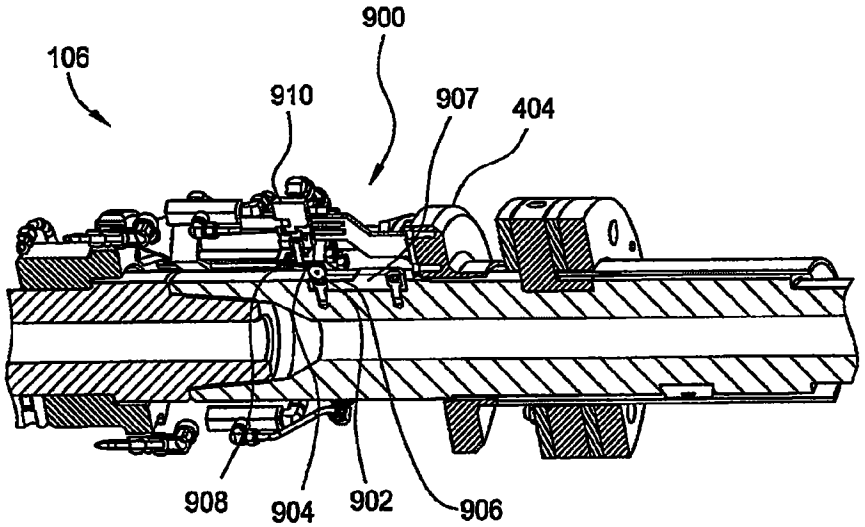

FIGS. 9A and 9B show a location system 900 that may be used with any tubular gripping assembly and any of the actuators 106 disclosed herein. The location system 900 may be incorporated into the actuator 106 having the piston and cylinder assembly 400, as shown. The location system 900 is adapted to track the movement of the slip ring 404 or the piston rod 406 as it is moved by the piston and cylinder assemblies 400. The location system 900 may be in communication with the controller 312 in order to monitor the engagement and disengagement of the gripping apparatus 104. The location system 900 tracks the position of pistons thereby, tracking the position of the gripping apparatus 104. The location system 900 may include a wheel 902 coupled to an arm 904, that is coupled to the piston rod 406, or in the alternative, the sleeve 214, or the slip ring 404. As the piston rod 406 moves the slip ring 404 from the disengaged to the engaged position, the wheel rolls on a track 906. The track 906 may include a raised portion 907. As the wheel 902 reaches the raised portion 907, it moves the arm 904 radially away from the mandrel 212 of the gripping apparatus 104. The arm 904 is coupled to a trigger 908 which actuates a location indicator 910. Thus, as the trigger 908 engages the location indicator 910, the height and position of the trigger 908 inside the location indicator 910 indicates the location of the piston rods 406 and or the slip ring 404 and thus of the location of the slips 208, not shown. Although shown as the track 906 having one raised portion it should be appreciated that the track 906 may have any configuration and indicate the entire spectrum of locations the piston rod 406 and/or slip ring 404 may be during actuation and disengagement of the gripping apparatus. The location system 900 may send and/or receive a pneumatic and/or hydraulic signal to the controller 312 and/or fluid source and further may send an electronic signal, either wirelessly or with a wired communication line. Further, the location system 900 may be any location locator including, but not limited to, a hall effect, a strain gauge, or any other proximity sensor. The sensor communication signals may be sent back through the swivel and/or sent via radio frequency.

Figure 10A:
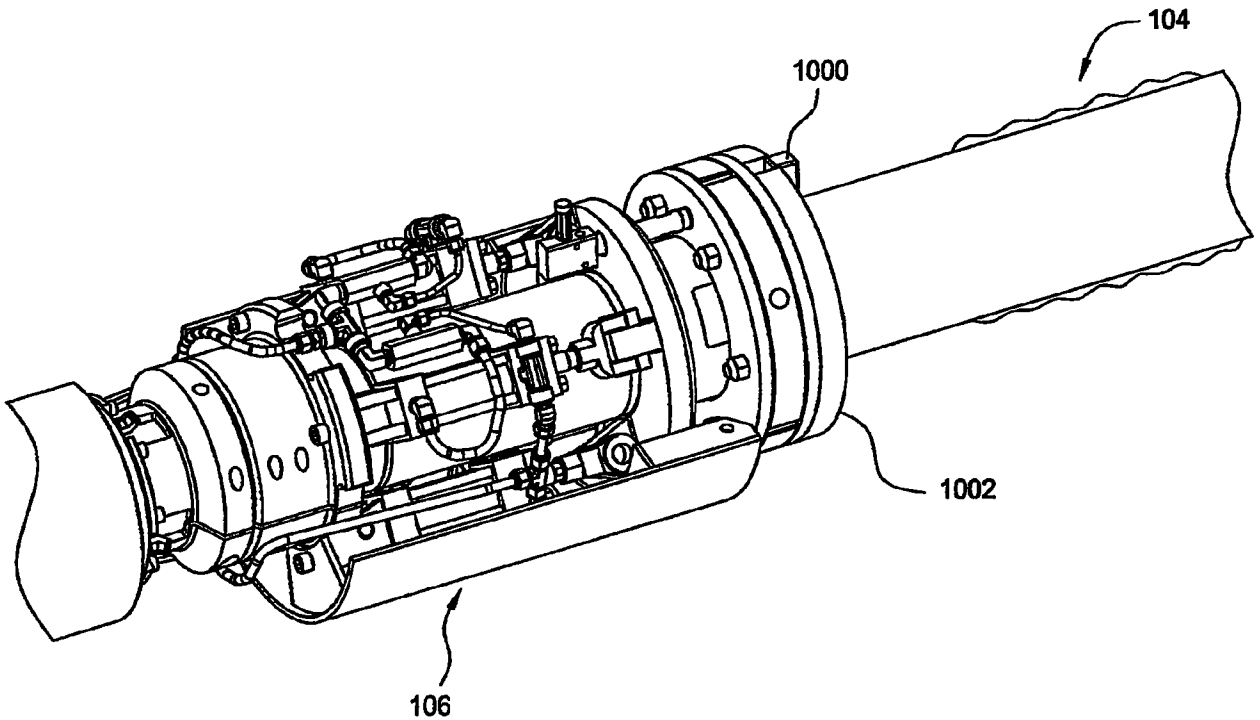
FIGS. 10A-10B show a schematic of a sensor according to one embodiment described herein.
Figure 10B:
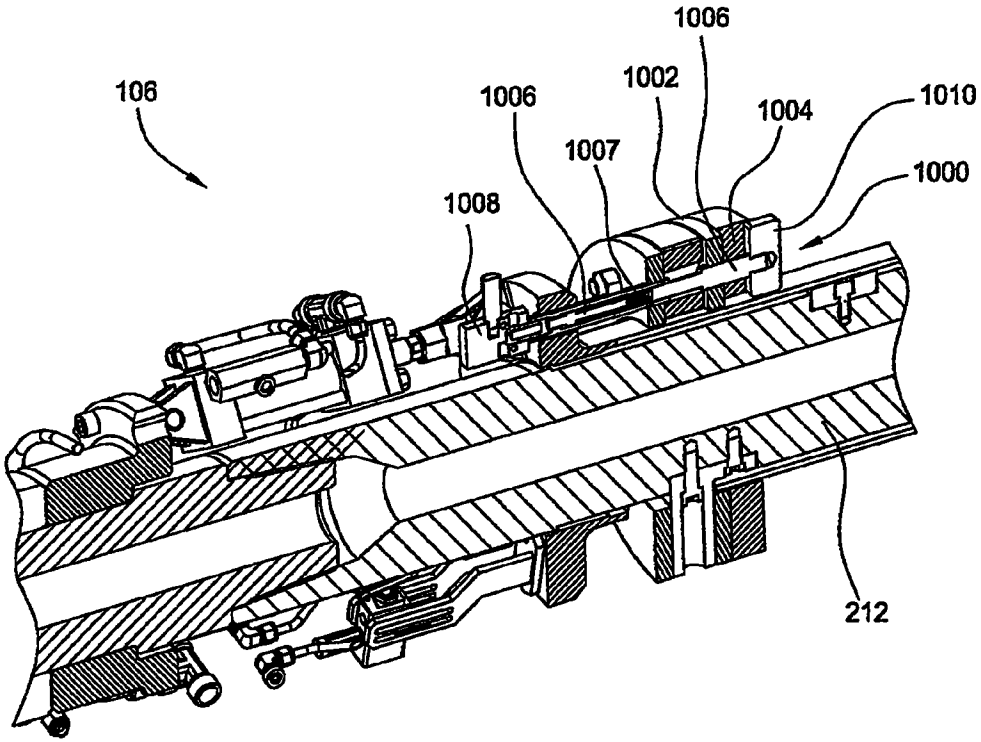

In yet another embodiment, the gripping apparatus 104 includes a sensor 1000 for indicating that a stop collar 1002 of the gripping apparatus 104 has reached the top of a tubular 112, as shown in FIGS. 10A and 10B. The stop collar 1002 is adapted to prevent the tubular 112 from moving beyond the gripping apparatus 104 as the gripping apparatus 104 engages the tubular 112. The sensor 1000 may detect the tubular 112 when the tubular 112 is proximate the stop collar 1002. In use, the hoisting system 110 and/or the drive mechanism 108 will initially lower the gripping apparatus 104 toward the tubular 112 to urge the engagement portion of the gripping apparatus 104 to enter the tubular 112, or surround the tubular 112 if the gripping apparatus is an external gripper. As the hoisting system 110 and/or drive mechanism 108 continues to move the gripping apparatus 104 relative to the tubular 112, the sensor 1000 will be actuated tubular 112 reaches a predetermined distance from the stop collar 1002. The sensor 1000 may send a signal to the controller 312 or an operator in order to indicate that the predetermined proximity of the stop collar 1002 to the tubular 112 has been reached. The controller 312 and/or the operator may then stop the hoisting system 110 and/or the drive mechanism 108 from continuing the movement of the gripping apparatus 104 relative to the tubular 112. The gripping apparatus 104 may then be activated to grip the tubular 112 to commence drilling and/or running operations.

The sensor 1000, as shown in FIGS. 10A and 10B, is a mechanical sensor which rests in a recess 1004 of the stop collar 1002 and is biased to project below the bottom surface of the stop collar 1002. FIG. 10B shows the sensor 1000 coupled to an activator 1006 which operates a control valve 1008. The activator 1006, as shown, is a rod which projects through the stop collar 1002 and is coupled to the control valve 1008 on one end and to a contact 1010, which is adapted to engage the tubular 112, on the other end. The sensor 1000 may include a spring 1007 for biasing the activator 1006 toward the unengaged position. Thus, as the gripping apparatus 104 is lowered into the tubular 112, the contact 1010 approaches the upper end of the tubular 112. Once the contact 1010 engages the tubular 112, the control valve 1008 is actuated and sends a signal to the controller 312 or the operator indicating that the gripping apparatus 104 is in the tubular 112. Although shown as a mechanical sensor, it should be appreciated that the sensor 1000 may be any sensor known in the art, such as a rod and piston assembly, a strain gage, a proximity sensor, optical sensor, infrared, a laser sensor. The sensor 1000 helps to prevent placing the full weight of the hoisting system 110, the actuator 106, and the drive mechanism 108 onto the top of the tubular 112 before the tubular 112 is connected to the tubular string 116. In one embodiment, the sensor 1000 status may be sent back through the swivel and/or sent via radio frequency.

Figures 11, 11A:
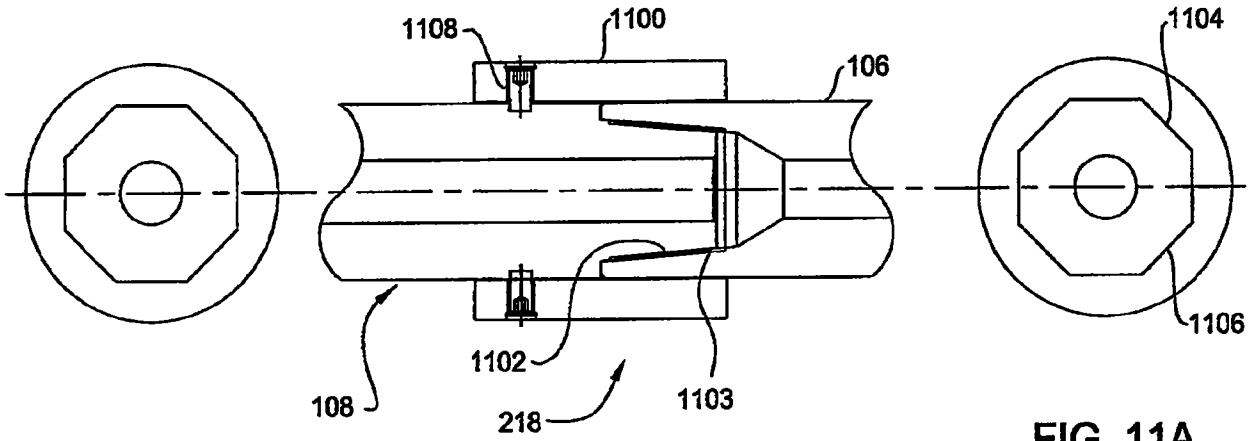
FIGS. 11, 11A-11C show a schematic of an adapter according to one embodiment described herein.

In yet another embodiment, the adapter 218, which may provide the connection between the components of the tubular handling system 102, contains a lock 1100 as shown in FIG. 11. The adapter 218 is located between the drive mechanism 108 and the actuator 106; however, it should be appreciated that the adapter 218 may be located between any of the tubular handling system 102 components. The lock 1100 prevents the inadvertent release of a connection between tubular handling system 102 components as a result of rotation of the components. As shown, the connection includes a pin connector 1102 of the drive mechanism 108 adapted to couple to the box end 1103 of the actuator 106. Both the pin connector 1102 and the box end 1103 have a shaped outer surface 1104. The shaped outer surface 1104 shown in FIG. 11A is an octagonal configuration; however, it should be appreciated that the shape may be any configuration capable of transferring torque, such as a gear or spline, a hex, a square, a locking key (pin), etc. The shaped outer surface 1104 is configured to match a shaped inner surface 1106 of the lock 1100. The lock 1100 may contain a set screw 1108 for coupling the lock 1100 to the pin connector 1102. Although the set screw 1108 is shown as connecting to the pin connector 1102, it should be appreciated that the set screw 1108 may couple to any part of the connection so long as the lock 1100 engages both the pin connector 1102 and the box end 1103. Thus, in operation, the lock 1100 is placed on the pin connector 1102 and the box end 1103 is coupled to the pin connector 1102. The lock 1100 is then moved so that the shaped inner surface 1106 engages the shaped outer surface 1104 of both the pin connector 1102 and the box end 1103. The set screws 1108 then couple the lock 1100 to the pin connector 1102. The drive mechanism 108 may then be actuated to rotate the tubular 112. As the drive mechanism 108 torques the connection, load is transferred through the lock 1100 in addition to the threaded connection. The lock 1100 prevents the overloading or unthreading of the connections. Although shown as the drive mechanism 108 having a pin end and the actuator 106 having a box end, any configuration may be used to ensure connection. Further, the lock may contain a sprag clutch to engage a top drive quill, thus eliminating the requirement to modify the outer diameter of the top drive quill, not shown.

Figure 11B:
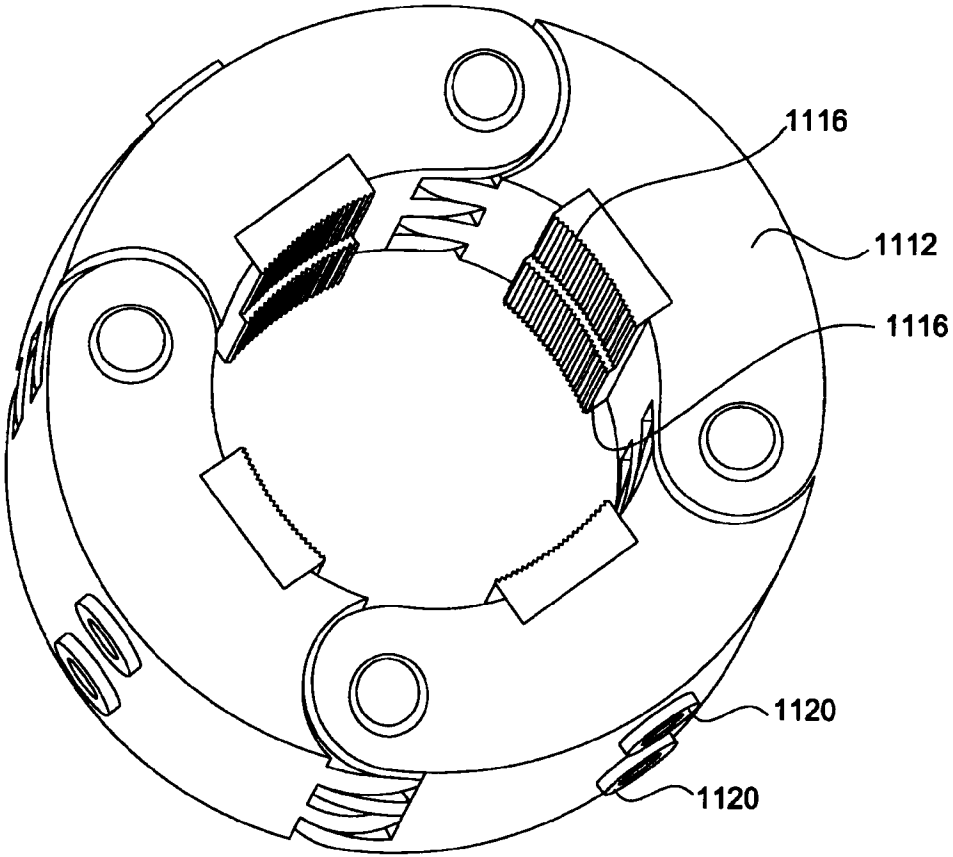
Figure 11C:
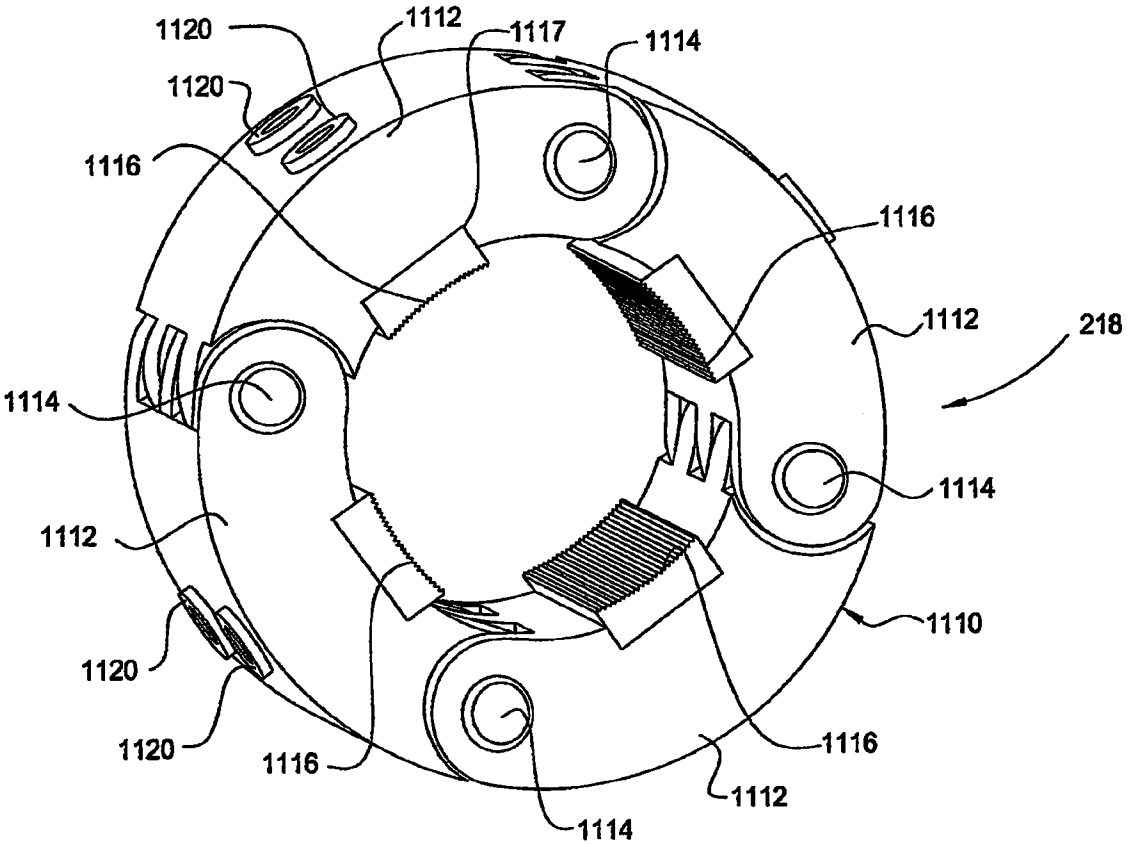

In yet another alternative embodiment, the adapter 218 is an external locking tool 1110 as shown in FIGS. 11C and 11B. The external locking tool 1110 may comprise two or more link elements 1112 connected to encompass the connection between tubular handling system 102 components. As shown, the link elements 1112 are pivotably connected to one another via a pin 1114. The pins 1114 may be removed in order to open the external locking tool 1110 and place the external locking tool 1110 around the connection. The pin 1114 may then be reinstalled lock the external locking tool 1110 around the connection. Further, any number of link elements 1112 may be removed or added in order to accommodate the size of the connection. The link elements 1112, when connected, form an interior diameter having two or more dies 1116. Each link element 1112 may have one or more recess 1117 adapted to house the die 1116. The interior diameter is adapted to be equal to or larger than the outer diameter of the connection between tubular handling system 102 components. The dies 1116 have an engagement surface 1118 which is adapted to grippingly engage the outer diameter of the connection between the tubular handling system 102 components. In one embodiment, the dies 1116 are large enough to traverse the connection between the tubular handling system components. Optionally, the dies 1116 may be radially adjustable via one or more adjustment screw 1120. The adjustment screw 1120 as shown traverses each of the link elements 1112. The adjustment screw 1120 engages the die 1116 on the interior of the link element 1112 and is accessible for adjustment on the exterior of the link element 1112. Although the adjustment screw 1120 is shown as a screw, it should be appreciated that any method of moving the dies radially may be used including but not limited to a fluid actuatable piston, an electric actuator, or a pin. In this manner, the link elements 1112 with the dies 1116 may be coupled together around a connection between two components. The dies 1116 may then be adjusted, if necessary, via the adjustment screws 1120 in order to grippingly engage the connection. Each die 1116 will transverse the connection and thereby grip both of the components. The dies 1116 coupled to the link elements 1112 will prevent the components from rotating relative to one another, thereby preventing inadvertent release of the connection.

FIG. 11B shows an alternative embodiment of the external locking tool 1110. As shown, each link element 1112 has at least two separate dies 1116. The dies are independently adjustable via the adjustment screw 1120. This allows each die 1116 to independently engage each component of the connection. Therefore, the components may have varying outer diameters and still be engaged by the separate dies 1116 of the external locking tool 1110. With the dies 1116 grippingly engaged with components, relative rotations between the components is prevented in the same manner as described above.

Figure 12A:
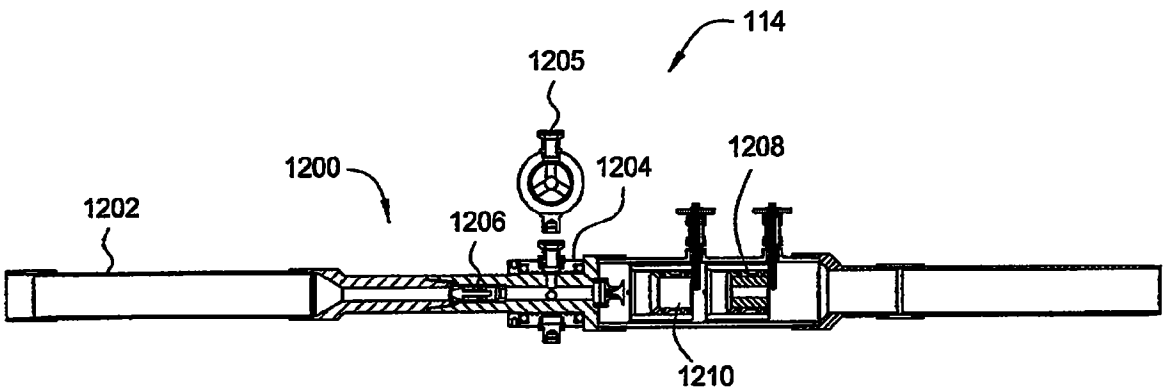
FIGS. 12A-12B show a schematic of a cement plug launcher according to one embodiment described herein.
Figure 12B:
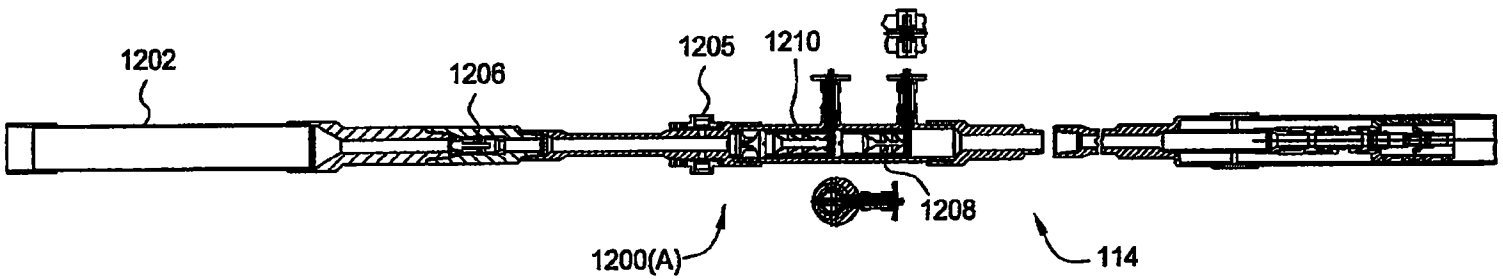

In another embodiment, equipment 114 is a cementing plug launcher 1200 adapted for use with the gripping apparatus 104, as shown in FIGS. 12A-12B. The cementing plug launcher 1200 may be adapted to be engaged by any tubular handling system 102 described herein in addition to any drilling rig tubular running device. For example, the cementing plug launcher 1200 may be adapted to couple to an internal gripping apparatus, an external gripping apparatus, or any combination of an external and/or an internal gripping apparatus. Using the cementing plug launcher 1200 in conjunction with the gripping apparatus 104 allows an operator to use a cementing tool without the need to rig down the gripping apparatus 104 prior to use. This saves rig time and reduces the exposure of the tubular string 116 to the uncemented wellbore. Further, the cementing plug launcher 1200 may be brought to the rig floor as one complete assembly, which may be handled and coupled to the tubular string 116 with the gripping apparatus. This allows fast operation while protecting the plugs inside the casing and the equipment 114. Further, the cementing plug launcher 1200 only needs to be attached to the tubular handling system 102 when the cementing operation is to take place. The cementing plug launcher 1200 may allow the tubular string 116 to be cemented in place without the need to pump cement through the gripping apparatus 104, the actuator 106, and the drive mechanism 108.

The cementing plug launcher 1200 will be described as used with an internal gripping apparatus 104. As shown in FIG. 12A, the launcher 1200 has an upper joint 1202 and an optional launcher swivel 1204, a fluid inlet 1205, and a valve 1206. The swivel 1204 may function in the same manner as the swivels mentioned above. The valve 1206 is shown as a check valve; however, it may be any valve including, but not limited to, a ball valve, a gate valve, a one way valve, a relief valve, and a TIW valve. The valve 1206 is adapted to prevent cement and/or drilling fluids from flowing through the cementing plug launcher 1200 during a cementing operation. Further, the valve 1206 may prevent the pumping pressure from affecting the load capacity of the gripping apparatus 104 during circulation or cementing. The upper joint 1202 of the launcher 1200 is adapted to be engaged by the gripping apparatus 104. Thus, after the tubular string 116 has been run and/or drilled or reamed to the desired depth, the gripping apparatus 104 may release the tubular string 116 and pick up the launcher 1200. To grip the launcher 1200, the gripping apparatus 104 is inserted into the upper joint 1202. The actuator 106 then activates the slips 208 into gripping engagement with the upper joint 1202. The gripping apparatus 104 and the cementing plug launcher 1200 are then lifted by the hoisting system over the tubular string 116. The hoisting system may then lower the cementing plug launcher 1200 toward the tubular string 116 for engagement therewith. The drive mechanism 108 may then rotate the cementing plug launcher 1200 to couple the cementing plug launcher 1200 to the tubular string 116. Thus, a cementing operation may be performed with little or no modifications to the tubular handling system 102. In one embodiment, the tubular handling system 102 may have the sealing ability to allow fluid to be pumped into the inner diameter of the cementing plug launcher 1200 above the valve 1206.

The cementing plug launcher 1200, shown in FIG. 12A, shows a typical launching head as is described in U.S. Pat. Nos. 5,787,979 and 5,813,457, which are herein incorporated by reference in their entirety, and the additional features of the launcher swivel 1204 and the upper joint 1202 adapted to be gripped by the gripping apparatus 104. The launcher 1200(*a*), shown in FIG. 12B, shows the use of a plug launching system that uses conventional plugs as well as non-rotational plugs such as described in U.S. Pat. No. 5,390,736, which is herein incorporated by reference in its entirety. The launcher 1200 (*a*) further includes a launcher swivel 1204 that allows a fluid to be pumped into the well while the valve 1206 prevents the fluid from flowing to the gripping apparatus 104. The fluid may be any fluid known in the art such as cement, production fluid, spacer fluid, mud, fluid to convert mud to cement, etc. The plug launching assembly 1200 and 1200A may allow the tubular string 116 to be rotated during the cementing operation. FIG. 12C shows the cementing plug launcher 1200(*b*) adapted for remote operation as will be described below.

It should be appreciated that cementing plug launchers 1200 and 1200A may be used in conjunction with clamps, casing elevators, or even another gripping apparatus such as a spear or external gripping device to connect to the previously run tubular string 116.

The cement plug launcher 1200 and 1200(A) are shown having manual plug releases. In yet another alternative embodiment, the cement plug launcher 1200 and 1200(A) are equipped with a remotely operated actuation system. In this embodiment the manual plug releases are replaced or equipped with by plug activators. The plug activators are fluid, electrically or wirelessly controlled from the controller 312. Therefore the controller or an operator at a remote location may release each plug 1208 and 1210 at the desired time using the plug activators. The plug activators typically remove a member which prevents the plug 1208/1210 from traveling down the cementing plug launcher 1200/1200(*a*) and into the tubular 112. Thus with the member removed after actuation of the plug activator, the plug 1208/1210 performs the cementing operation. The fluid or electric lines used to operate the plug activators may include a swivel in order to communicate with the plug activators during rotation of the cementing plug launcher 1200 and 1200(A). In an alternative, the plug activators may release a ball or a dart adapted for use with the plugs 1208 and 1210.

During a cementing operation it may be beneficial to reciprocate and/or rotate the tubular string 116 as the cement enters the annulus between the wellbore 115 and the tubular string 116. The movement, reciprocation and/or rotation, may be accomplished by the hoisting system 110 and the drive mechanism 108 and helps ensure that the cement is distributed in the annulus. The remotely operated actuation system for the cement plug launcher may be beneficial during the movement of the tubular string 116 in order to prevent operators from injury while releasing the plugs 1208 and 1210 due to the movement of the cement plug launcher.

While the cementing plug launcher may be used or discussed with the redundant safety mechanism for a gripping apparatus, it will be understood that the launcher need not be associated with any other aspect or subject matter included herein.

Figure 13:
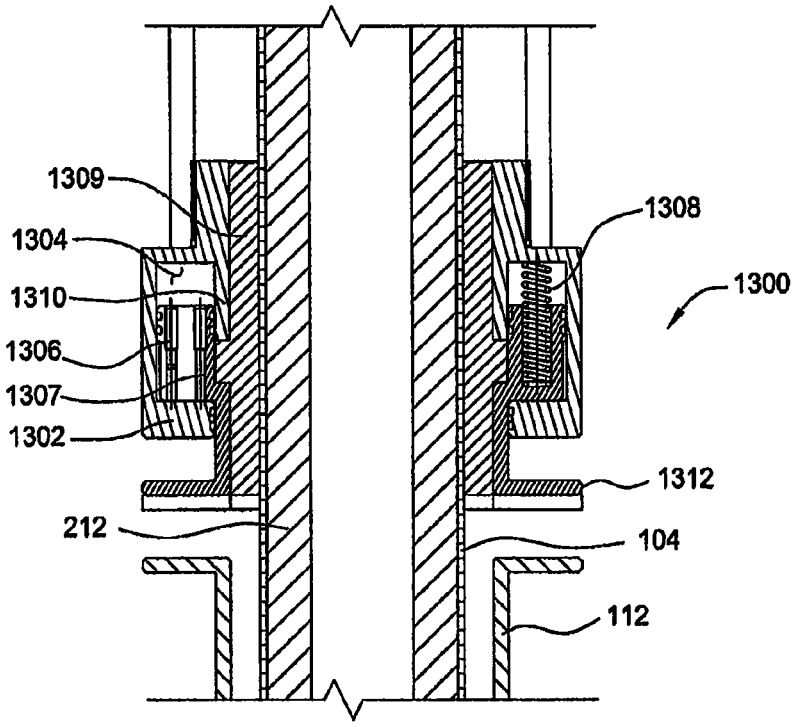
FIG. 13 is a schematic view of a release mechanism according to one embodiment described herein.

In an additional embodiment, the tubular handling system 102 may include a release 1300, shown in FIG. 13. During the operation of the tubular handling system with a slip type internal gripping apparatus it is possible that the slips 208, shown in FIG. 2, may become stuck in the tubular 112. This may occur when the slips 208 of the gripping apparatus 104 inadvertently engage the tubular 112 at a position where the gripping apparatus 104 is unable to move relative to the tubular 112. For instance the stop collar 1002 of the gripping apparatus 104 encounters the top of the tubular 112 and the slips 208 engage the tubular 112. At this point, pulling the gripping apparatus 104 up relative to the tubular 112 further engages the slips 208 with the tubular 112, additionally movement downward relative to the tubular 112, to release the slips 208, is prohibited due to the stop collar 1002 and the top of the tubular 112 being in contact with one another. The release 1300 is adapted to selectively release the gripping apparatus 104 from the tubular 112 in the event that the gripping apparatus is stuck and may be incorporated into the stop collar 1002 or may be a separate unit. The release 1300 may have a release piston 1302 and a release chamber 1304. The release chamber 1304 may be coupled to the release piston via a fluid resistor 1306, such as a LEE AXIAL VISCO JET™ and a valve 1307. The valve 1307 as shown is a one way valve, or check valve. The fluid resistor 1306 prevents fluid pressure in the release chamber 1304 from quickly actuating the release piston 1302. The valve 1307 prevents fluid from flowing from the release chamber 1304 toward the release piston 1302 while allowing fluid to flow in the opposite direction. The release 1300 may further include a biasing member 1308 adapted to biased the release piston 1302 toward the unengaged position as shown in FIG. 13. The release 1300 operates when stop collar 1002 engages the tubular 112 and weight is placed on the mandrel 212 of the gripping apparatus 104 by the hoisting system, shown in FIG. 1. The mandrel 212 may be coupled to the release piston 1302 by a coupling device 1309. A downward force placed on the mandrel 212 compresses the fluid in the release chamber 1304. The initial compression will not move the release piston 1302 due to the fluid resistor 1306. Continued compression of the release chamber 1304 flows fluid slowly through the fluid resistor 1306 and acts on the release piston 1302. As the release piston 1302 actuates a piston cylinder 1310, the piston cylinder 1310 moves the mandrel 212 up relative to the stop collar 1002. Thus, the mandrel 212 slowly disengages the slips 208 from the tubular 112 with continued compression of the release chamber 1304. Further, the fluid resistor 1306 prevents accidental release of the slips 208 caused by sudden weight on the mandrel 212. The continued actuation of the release chamber 1304 to the maximum piston stroke will release the slips 208. The gripping apparatus 104 may then be removed from the tubular. When weight is removed from the stop collar 1002 the pressure in the release chamber quickly subsides. The biasing member 1308 pushes the piston back toward the unengaged position and the valve 1307 allows the fluid to return to the release chamber. In another embodiment the release 1300 is equipped with an optional shoulder 1312. The shoulder 1312 is adapted to rest on top of the tubular 112.

Figure 14:
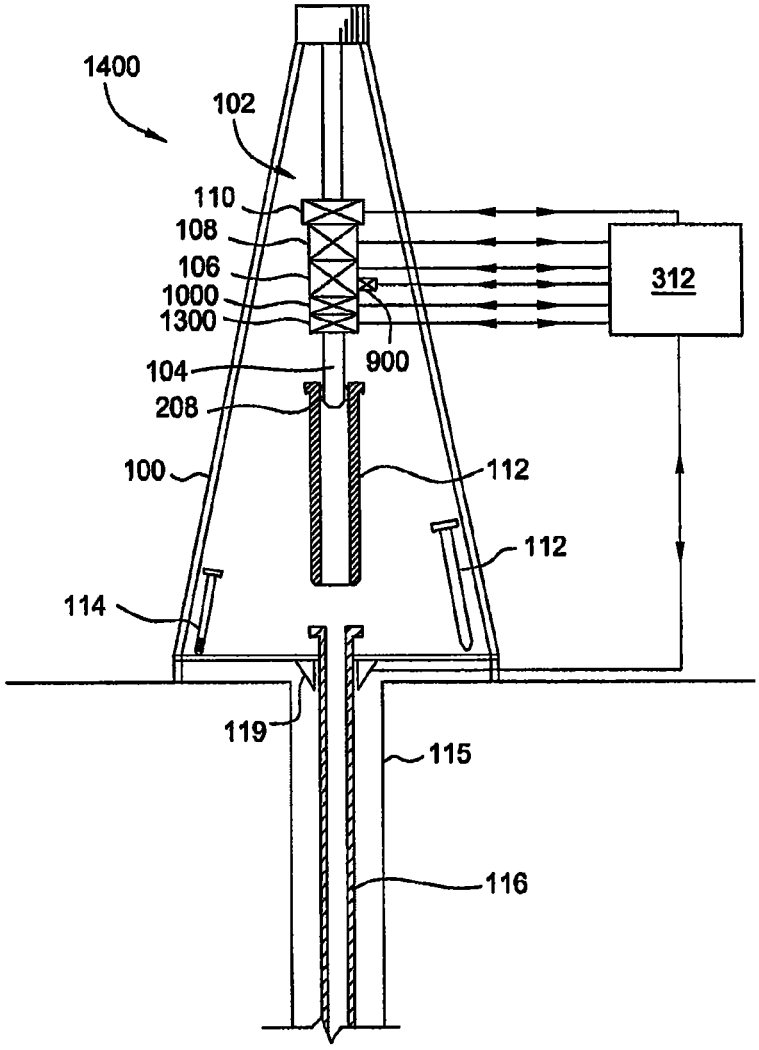
FIG. 14 is a schematic view of a tubular handling system and a controller according to one embodiment described herein.

FIG. 14 is a schematic view of an integrated safety system 1400 and/or an interlock. The integrated safety system 1400 may be adapted to prevent damage to the tubular 112 and/or the tubular string 116 during operation of the tubular handling system 102. In one embodiment, the integrated safety system 1400 is electronically controlled by the controller 312. The integrated safety system 1400 is adapted to prevent the release of the gripping apparatus 104 prior to the gripper 119 gripping the tubular 112 and/or the tubular string 116. For example, in a tubular running operation, the controller 312 may initially activate the actuator 106 of the gripping apparatus 104 to grip the tubular 112. The controller 312 may then activate rotation of the gripping apparatus 104 to couple the tubular 112 to the tubular string 116. The controller 312 may then release the gripper 119 while still gripping the tubular 112 and the tubular string 116 with the gripping apparatus 104. The controller 312 will prevent the release of the tubular 112 prior to the gripper 119 re-gripping the tubular 112 and the tubular string 116. Once the gripper 119 has re-gripped the tubular 112, the controller 312 will allow the release of the tubular 112 by the gripping apparatus 104.

The integrated safety system 1400 may also be capable of monitoring the proper amount of torque in the threads of the tubulars 112 during make up. This ensures that the threads are not damaged during make up and that the connection is secure. Examples of suitable safety systems are illustrated in U.S. Pat. No. 6,742,596 and U.S. Patent Application Publication Nos. U.S. 2005/0096846, 2004/0173358, and 2004/0144547, which are herein incorporated by reference in their entirety.

In another embodiment, the integrated safety system 1400 may incorporate the location system 900. The location system 900 sends a signal to the controller 312, which gives the status of the gripping apparatus 104 in relation to the tubular 112. In other words, the location system 900 indicates to the controller 312 when the tubular 112 is gripped or ungripped by the gripping apparatus 104. In operation, after the gripping apparatus 104 grips the tubular 112, the location system 900 sends a signal to the controller 312 indicating that the tubular 112 is gripped and it is safe to lift the gripping apparatus 104. The gripping apparatus 104 is manipulated by the drive mechanism 108 and/or the hoisting system 110 to couple the tubular 112 to the tubular string 116. The controller 312 may then open the gripper 119 to release the tubular string 116. The tubular 112 is lowered and regripped by the gripper 119 as described above. The controller 312 then releases the gripping apparatus 104 from the tubular 112. The location system 900 informs the controller 312 when the gripping apparatus 104 is safely disengaged from the tubular 112. The gripping apparatus 104 may then be removed from the tubular 112 without marking or damaging the tubular 112.

The integrated safety system 1400 may incorporate the sensor 1000 in another embodiment. The sensor 1000 sends a signal to the controller 312 when the stop collar 1002 is proximate to the tubular 112. Therefore, as the gripping apparatus 104 approaches the tubular 112 and/or the tubular string 116, a signal is sent to the controller 312 before the stop collar 1002 hits the tubular 112. The controller 312 may then stop the movement of the gripping apparatus 104 and, in some instances, raise the gripping apparatus 104 depending on the operation. The stopping of the gripping apparatus prevents placing weight on the tubular 112 when do so is not desired. In another embodiment, the signal may set off a visual and/or audible alarm in order to allow an operator to make a decision on any necessary steps to take.

In yet another embodiment, the integrated safety system 1400 may incorporate the release 1300. The release 1300 may send a signal to the controller 312 when the release begins to activate the slow release of the gripping apparatus 104. The controller 312 may then override the release 1300, lift the gripping apparatus 104, and/or initiate the actuator 106 in order to override the release 1300, depending on the situation. For example, if the slow release of the gripping apparatus 104 is initiated by the release 1300 prior to the gripper 119 gripping the tubular 112, the controller may override the release 1300, thereby preventing the gripping apparatus 104 from releasing the tubular 112.

In yet another alternative embodiment, the integrated safety system 1400 is adapted to control the compensator 700 via the controller 312. When the compensator 700 is initiated during the coupling of the tubular 112 to the tubular string 116, the compensator 700 may send a signal to the controller 312. The compensator 700 may measure the distance the tubular 112 has moved down during coupling. The distance traveled by the compensator 700 would indicate whether the connection had been made between the tubular 112 and the tubular string 116. With the connection made, the controller 312 may now allow the gripping apparatus 104 to disengage the tubular 112 and/or the compensator to return to its initial position.

In an alternative embodiment, the integrated safety system may be one or more mechanical locks which prevent the operation of individual controllers for one rig component before the engagement of another rig component.

In operation, the gripping apparatus 104 attaches to the drive mechanism 108 or the swivel 200, which are coupled to the hoisting system 110 of the rig 100. The tubular 112 is engaged by an elevator (not shown). The elevator may be any elevator known in the art and may be coupled to the tubular handling system 102 by any suitable method known in the art. The elevator then brings the tubular 112 proximate the gripping apparatus 104. In an alternative embodiment, the gripping apparatus may be brought to the tubular 112. The gripping apparatus 104 is then lowered by the hoisting system 110 or the elevator raises the tubular 112 relative to the gripping apparatus 104 until the slips 208 are inside the tubular 112. When the stop collar 1002 of the gripping apparatus 104 gets close to the tubular 112, the sensor 1000 may send a signal to the controller 312. The controller 312 may then stop the relative movement between the gripping apparatus 104 and the tubular 112.

With the gripping apparatus 104 is at the desired location, the controller 312 either automatically or at the command of an operator activates the actuator 106. At least the primary actuator of the actuator 106 is activated to urge the slips 208 into engagement with the tubular 112. One or more redundant actuators may be actuated either simultaneously with or after the primary actuator is actuated. The primary actuator will ensure that the slips 208 engage the tubular while the redundant actuators will ensure that the tubular 112 is not prematurely released by the gripping apparatus 104. The operation of the primary actuator and the redundant actuators are monitored by the controller 312 and/or the operator.

As the actuator 106 activates the gripping apparatus 104, the location system 900 may send a signal to the controller 312 regarding the location of the slips 208 in relation to the tubular 112. After the tubular 112 is engaged, the drive mechanism 108 and or hoisting system 110 may bear the weight of the tubular 112 for connection to a tubular string 116. The tubular handling system 102 then lowers the tubular 112 until the tubular 112 is engaged with the tubular string 116. The drive mechanism 108 may then rotate the tubular 112 in order to couple the tubular 112 to the tubular string 116. During the coupling of the tubular 112 to the tubular string 116, the compensators 700 may compensate for any axial movement of the tubular 112 relative to the drive mechanism 108. The compensation prevents damage to the tubular 112 threads. The compensator 700 may indicate to the controller 312 the extent of the connection between the tubular 112 and the tubular string 116. As the drive mechanism 108 transfers rotation to the tubular 112 via the gripping apparatus 104 and the slips 208, the swivel allows for communication between the rotating components and the controller 312 or any fluid/electric sources. After the connection of the tubular 112 to the tubular string 116 is made up, the gripper 119 may release the tubular string 116, while the gripping apparatus 104 continues to support the weight of the tubular 112 and the tubular string 116. The hoisting system 110 then lowers the tubular string 116 to the desired location. The gripper 119 then grips the tubular string 116. The controller 312 may then disengage the slips 208 either by use of the release 1300 or de-activating the actuator 106 to release the tubular string 116. During this sequence, the integrated safety system 1400 may prevent the tubular string 116 from being inadvertently dropped into the wellbore 115. The process may then be repeated until the tubular string 116 is at a desired length. In one embodiment the integrated safety system As the tubular string 116 is lowered into the wellbore 115, drilling fluids may be pumped into the tubular string 116 through the gripping apparatus 104. The drilling fluids flow through the flow path 206 (shown in FIG. 2) of the gripping apparatus 104. The packer 204 of the pack off 202 prevents the drilling fluids from inadvertently escaping from the top of the tubular string 116.

After the lowering the tubular 112 and the tubular string 116, the gripping apparatus 104 may then be used to engage the equipment 114 in the manner described above. In one embodiment, the equipment is the cement plug launcher 1200/1200A shown in FIGS. 12A-12B. The gripping apparatus 104 first engages the upper joint 1202, then the cement plug launcher 1200 couples to the tubular string 116. Thereafter, a first plug 1208 is dropped into the tubular string 116, either by the controller 312 or manually by an operator. Cement may then be pumped into the cement plug launcher 1200 via the fluid inlet 1205 and flow down the tubular string 116 behind the first plug 1208. The swivel 1204 allows the cement to be pumped into the cement plug launcher 1200 while the drive mechanism 108 rotates and/or reciprocating the tubular string 116, if necessary. After the necessary volume of cement has been pumped into the tubular string 116, the controller 312 and/or operator drops a second plug 1210.

The second plug 1210 may be pushed down the tubular string 116 by any suitable fluid such as drilling fluid. The second plug 1210 continues to move down the tubular string 116 until it lands on the first plug 1208. The cement is then allowed to dry in an annulus between the tubular string 116 and the wellbore 115. The cement plug launcher 1200 may then be removed from the tubular string 116 and thereafter disconnected from the gripping apparatus 104.

With the tubular string 116 cemented in place, the gripping apparatus 104 may be removed from the actuator 106. One of the modular gripping apparatus 804, shown in FIG. 8, may then be coupled to the actuator 106 in order to accommodate a different sized tubular 112. A new tubular string 116 may be made up and run into the cemented tubular string 116 in the same manner as described above. The new tubular string may be equipped with a milling and/or drilling tool at its lower end in order to mill out any debris in the tubular string 116 and/or drill the wellbore 115. The same procedure as described above is used to run and set this tubular string 116 into the wellbore. This process may be repeated until the tubular running is completed. This process may be reversed in order to remove tubulars from the wellbore 115.

In yet another embodiment described herein, an apparatus for gripping a tubular for use with a top drive is disclosed. The apparatus includes a connection at one end for rotationally fixing the apparatus relative to the top drive and one or more gripping members at a second end for gripping the tubular. Further, the apparatus includes a primary actuator configured to move and hold the gripping members in contact with the tubular, and a backup assembly adapted to maintain the gripping member in contact with the tubular.

In yet another embodiment, the primary actuator is fluidly operated.

In yet another embodiment, the primary actuator is electrically operated.

In yet another embodiment, wherein the backup assembly comprises a selectively powered redundant actuator.

In yet another embodiment, the backup assembly is hydraulically operated.

In yet another embodiment, a monitor is coupled to a controller for monitoring a condition in the backup assembly.

In yet another embodiment, the monitor monitors a condition in the primary actuator.

In yet another embodiment, the backup assembly comprises a check valve operable in conjunction with the primary actuator to ensure the primary actuator remains operable in the event of hydraulic failure.

In yet another embodiment, the backup assembly further includes an additional source of fluids to ensure the primary actuator remains operable in the event of hydraulic failure.

In yet another embodiment, a first swivel in configured to communicatively couple the primary actuator to a fluid source. Additionally a second swivel may couple to the backup assembly configured to communicatively couple the backup assembly to the fluid source. Additionally, a second fluid source may be provided.

In yet another embodiment, the connection comprises a lock for preventing the apparatus and the top drive from rotating independently of one another. Further, the lock may include a shaped sleeve for engaging a shaped outer diameter of the top drive and the apparatus. Alternatively, the lock may include two or more link elements configured to surround the connection, and one or more gripping dies on an inside surface of each link element, the one or more gripping dies configured to engage the apparatus and the top drive.

In yet another embodiment, a release may be actuated by applying weight to the apparatus to actuate a fluid operated piston. Further, the fluid operated piston may be coupled to a fluid resistor for constricting fluid flow. Additionally, the fluid resistor may act to release the gripping members from the tubular using a substantially constant force applied over time.

In yet another embodiment described herein, an apparatus for gripping a tubular for use in a wellbore is described. The apparatus may include a gripping member for gripping the tubular, wherein the gripping member is coupled to a rotating mandrel. Further, the apparatus may include an actuator for actuating the gripping member and a locking member for locking the gripping member into engagement with an inner diameter of the tubular. Additionally, the apparatus may include a swivel for connecting the actuator to the gripping member.

In yet another embodiment, the actuator comprises one or more chambers controlled by fluid pressure. Further, the fluid pressure may actuate a piston.

In yet another embodiment, the locking member includes one or more pressure chambers connected to a fluid source configured to provide.

In yet another embodiment, the locking member is one or more check valves provided between a fluid source and the one or more pressure chambers.

In yet another embodiment, a controller for monitoring the fluid pressure in the one or more pressure chambers.

In yet another embodiment, a release actuated by applying weight to the gripping apparatus to actuate a fluid operated piston is included. Further, the fluid operated piston may be coupled to a fluid resistor for constricting fluid flow. Additionally the fluid resistor may act to release the gripping members using a constant force applied over time.

In yet another embodiment described herein, an apparatus for gripping a tubular for use in a wellbore comprising is described. The apparatus may include a set of slips connectable to a rotating mandrel for engaging an inner diameter of the tubular. Further, the apparatus may include a plurality of fluid chambers for actuating the slips and a swivel for fluidly connecting a fluid source to the plurality of fluid chambers.

In yet another embodiment, the chambers comprise one or more primary actuators and one or more redundant actuators.

In yet another embodiment, the redundant actuator has a locking member.

In yet another embodiment, the locking member comprises a check valve configured to hold pressure in the redundant actuator. Further, the check valve may allow one way flow of fluid into at least one of the plurality of fluid chambers.

In yet another embodiment, the fluid source supplies a hydraulic fluid.

In yet another embodiment, the fluid source comprises a pneumatic fluid.

In yet another embodiment, a controller for monitoring at least one of the plurality of fluid chambers is provided.

In yet another embodiment, a sensor may be coupled to a stop collar, wherein the sensor is configured to communicate to the controller when the stop collar engages the tubular.

In yet another embodiment, a control line may be connectable to the swivel and the plurality of fluid chambers.

In yet another embodiment described herein, a method for connecting a tubular is described. The method includes providing a fluid pressure from a fluid source and conveying the fluid pressure through a swivel to a plurality of chambers. Further, the swivel may have two or more annular seals located in a recess on each side of a fluid inlet. The method additionally includes actuating a gripping member to grip the tubular, wherein the gripping member is actuated by applying a fluid pressure to a piston within the plurality of chambers. The method additionally may include rotating the tubular using the gripping member and moving a pressurized fluid into cavities between the two or more annular seals and the recess in response to rotating the tubular. Further, the method may include continuing to supply the fluid source through the swivel and into the chambers via the swivel during rotation.

In yet another embodiment, the method further includes locking at least one chamber of the plurality of chambers upon actuation, wherein locking the at least one chamber may include flowing fluid through a check valve.

In yet another embodiment, the method further includes monitoring at least one of the plurality of chambers with a controller. Additionally, the gripping member may be operatively coupled to a top drive. Further, the gripping member may be rotated by the top drive.

In yet another embodiment described herein, a tubular handling system is described. The tubular handling system includes a tubular torque device coupled to a hoisting system and a gripping apparatus. Additionally, the tubular handling system includes a cementing plug launcher configured to selectively coupled to the gripping apparatus having a tubular housing for receiving the gripping member, and one or more plugs located within the tubular housing configured to perform a cementing operation.

In yet another embodiment, a check valve may be disposed within the tubular housing configured to prevent fluid flow from the launcher to the gripping apparatus.

In yet another embodiment, a swivel that allows for a fluid to be pumped into the launcher while the torque device rotates the launcher is provided.

In yet another embodiment, the gripping member comprises a spear.

In yet another embodiment, the gripping member comprises an external tubular gripper.

In yet another embodiment described herein, a method of completing a wellbore is described. The method includes providing a tubular handling system coupled to a hoisting system, wherein the tubular handling system comprises a gripping apparatus, an actuator, and a torquing apparatus. The method further includes gripping a first tubular using the gripping apparatus and coupling the first tubular to a tubular string by rotating the first tubular using the torquing apparatus, wherein the tubular string is partially located within the wellbore. Additionally, the method may include lowering the first tubular and the tubular string and releasing the first tubular from the gripping apparatus. The method may further include gripping a cementing tool using the gripping apparatus and coupling the cementing tool to the first tubular by rotating the cementing tool. Additionally the method may include flowing cement into the cementing tool and cementing at least a portion of the tubular string into the wellbore.

In yet another embodiment, the method includes preventing cement from flowing into contact with the gripping apparatus with a check valve.

In yet another embodiment described herein, a release for releasing a gripping apparatus from a tubular is described. The release includes a piston and a piston cylinder operatively coupled to a mandrel of the gripping apparatus. The release further includes a fluid resistor configured to fluidly couple a release chamber to the piston by providing a constrained fluid path. Additionally the release may include a shoulder adapted to engage a tubular and increase pressure in the release chamber as weight is applied to the shoulder, and wherein continued weight on the shoulder slowly actuates the piston thereby slowly releasing the gripping apparatus from the tubular.

While the foregoing is directed to embodiments of the present invention, other and further embodiments of the invention may be devised without departing from the basic scope thereof, and the scope thereof is determined by the claims that follow.

What is claimed is:

1. A method for operating a tubular handling system, the method comprising:

moving a gripping apparatus toward a tubular;

inserting the gripping apparatus into the tubular;

detecting the presence of an upper end of the tubular using a sensor located on the gripping apparatus during insertion of the gripping apparatus;

sending a signal from the sensor to a controller indicating that the tubular is in an engageable position;

stopping movement of the gripping apparatus relative to the tubular in response to the signal, wherein the tubular is stopped before contact with a stop collar in the gripping apparatus; and gripping the tubular with the gripping apparatus.

2. The method of claim 1, further comprising monitoring a position of one or more engagement members of the gripping apparatus relative to the tubular using a second sensor, and sending a second signal to the controller indicating that the gripping apparatus is engaged with the tubular.

3. The method of claim 2, wherein monitoring a position of one or more engaging members comprises monitoring an entire spectrum of location of the engagement members.

4. The method of claim 2, wherein monitoring a position of one or more engaging members comprises monitoring a piston for actuating the engagement members.

5. The method of claim 4, wherein the second sensor comprises a wheel coupled to the piston.

6. The method of claim 2, further comprising coupling the tubular to a tubular string held by a spider on the rig floor and verifying that the tubular connection is secure.

7. The method of claim 6, further comprising after verifying the tubular connection is secured and the gripping apparatus is secured, the controller permits release of the spider.

8. The method of claim 1, further comprising transferring torque from the tubular gripping apparatus to the tubular, thereby rotating the tubular.

9. A tubular handling system for handling a tubular, comprising:

a tubular gripping apparatus having a gripping mechanism;

a stop collar for limiting axial movement of the tubular relative to the tubular gripping apparatus; and a sensor adapted to track movement of the gripping mechanism, wherein the sensor sends a signal to a controller when the gripping apparatus is in a position that corresponds to the gripping apparatus being engaged with the tubular.

10. The system of claim 9, wherein the sensor comprises a trigger which is actuated by a wheel coupled to an arm, wherein the wheel moves along a track coupled to an actuator as the actuator moves the gripping mechanism.

11. The system of claim 10, wherein the track has one or more upsets configured to move the wheel radially and actuate the trigger as the wheel travels.

12. The system of claim 9, further comprising an indicator sensor for indicating a position of the gripping apparatus relative to the tubular.

13. The system of claim 9, wherein the gripping mechanism is adapted to be engage an interior surface of the tubular.

14. The system of claim 9, wherein the tubular gripping apparatus is adapted to grip the tubular and transfer torque to the tubular, to thereby rotate the tubular.

15. A method for operating a tubular handling system, the method comprising:

moving a gripping apparatus toward a tubular;

detecting the presence of an upper end of the tubular using a sensor located on the gripping apparatus;

sending a signal from the sensor to a controller indicating that the tubular is in an engageable position;

stopping movement of the gripping apparatus relative to the tubular in response to the signal, wherein the tubular is stopped before contact with a stop collar in the gripping apparatus; and gripping the tubular with the gripping apparatus.

16. A tubular handling system for handling a tubular, comprising:

a tubular gripping apparatus having a gripping mechanism; and a sensor adapted to track movement of the gripping mechanism, wherein the sensor sends a signal to a controller when the gripping apparatus is in a position that corresponds to the gripping apparatus being engaged with the tubular, and wherein the sensor comprises a trigger which is actuated by a wheel coupled to an arm, wherein the wheel moves along a track coupled to an actuator as the actuator moves the gripping mechanism.

17. The system of claim 16, wherein the track has one or more upsets configured to move the wheel radially and actuate the trigger as the wheel travels.

18. A method for operating a tubular handling system, the method comprising:

lowering a gripping apparatus axially relative to a tubular, thereby inserting the tubular into the gripping apparatus;

detecting the presence of an upper end of the tubular using a sensor located on the gripping apparatus during insertion of the tubular;

sending a signal from the sensor to a controller indicating that the tubular is in an engageable position;

stopping movement of the gripping apparatus relative to the tubular in response to the signal; and gripping the tubular with the gripping apparatus.

19. A method for operating a tubular handling system, the method comprising:

moving a gripping apparatus toward a tubular;

detecting the presence of an upper end of the tubular using a sensor located on the gripping apparatus;

sending a signal from the sensor to a controller indicating that the tubular is in an engageable position;

stopping movement of the gripping apparatus relative to the tubular in response to the signal; and operating the gripping apparatus to grip the tubular from the stopped position.

* * * * *